US007277650B2

(12) United States Patent
Ihara et al.

(10) Patent No.: US 7,277,650 B2
(45) Date of Patent: Oct. 2, 2007

(54) IMAGE FIXING CONTROLLER WITH TIME/TEMPERATURE CONTROL

(75) Inventors: Hirofumi Ihara, Fukuoka (JP); Tomoyuki Noguchi, Fukuoka (JP); Yasuhiro Nonaka, Saga (JP); Tadayuki Kajiwara, Fukuoka (JP); Masahiro Samei, Fukuoka (JP); Hideki Tatematsu, Hyogo (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 97 days.

(21) Appl. No.: 10/896,939

(22) Filed: Jul. 23, 2004

(65) Prior Publication Data

US 2005/0041991 A1 Feb. 24, 2005

(30) Foreign Application Priority Data

Jul. 25, 2003 (JP) ..... P.2003-279825
Jul. 25, 2003 (JP) ..... P.2003-279827

(51) Int. Cl.
*G03G 15/20* (2006.01)

(52) U.S. Cl. ..... 399/67

(58) Field of Classification Search ..... 399/67
See application file for complete search history.

(56) References Cited

U.S. PATENT DOCUMENTS 4,952,781 A 8/1990 Kozaiku
5,681,494 A 10/1997 Suzuki et al.
5,837,976 A * 11/1998 Loveless et al. ..... 219/645
6,037,576 A 3/2000 Okabayashi et al.
6,405,000 B1 * 6/2002 Nakaya ..... 399/67
6,651,026 B2 * 11/2003 Yamauchi et al. ..... 399/69
6,763,204 B2 * 7/2004 Kondo et al. ..... 399/67
2002/0108947 A1 * 8/2002 Tsuruya ..... 399/328
2006/0072931 A1 * 4/2006 Asakura et al. ..... 399/33

FOREIGN PATENT DOCUMENTS

JP 1-298385 12/1989
JP 5-274047 10/1993

(Continued)

OTHER PUBLICATIONS

English language Abstract of JP 08-022206.

(Continued)

*Primary Examiner*—David M. Gray
*Assistant Examiner*—Ruth N LaBombard
(74) *Attorney, Agent, or Firm*—Greenblum & Bernstein, P.L.C.

(57) ABSTRACT

An image fixing device that is controllable with a high degree of reliability. The image fixing device is configured with a heat generator for fixing a toner image onto a recording medium that is opposed to an induction heater. Heat is generated in the heat generator through electromagnetic induction. An inverter circuit drives the induction heater. A power controller controls a power value that is output from the inverter circuit, whose power value is calculated by a power-value calculator. A power-value sensor acquires the power value output from the power controller, and a temperature sensor senses a temperature at least at one point of the heat generator. Thus, either the power value sensed by the power-value sensor or a temperature value sensed by the temperature sensor may be used as a reference value to calculate the power value in the power-value calculator.

20 Claims, 17 Drawing Sheets

| | ENVIRONMENTAL TEMPERATURE 15°C OR MORE | | | ENVIRONMENTAL TEMPERATURE 15°C OR LESS | | |
|---|---|---|---|---|---|---|
| | CONTROL UPPER LIMIT TEMPERATURE | CONTROL LOWER LIMIT TEMPERATURE | INITIAL CONTROL POWER | CONTROL UPPER LIMIT TEMPERATURE | CONTROL LOWER LIMIT TEMPERATURE | INITIAL CONTROL POWER |
| MODE 0 | 100°C | 97°C | 50W | 92°C | 87°C | 62.5W |
| MODE 1 | 130°C | 110°C | POWER DURING THE PRINTING | 130°C | 110°C | POWER DURING THE PRINTING |
| MODE 2 | 100°C | 97°C | 130W | 92°C | 87°C | 130W |
| MODE 3 | 100°C | 97°C | 100W | 92°C | 87°C | 100W |
| MODE 4 | 100°C | 97°C | 60W | 92°C | 87°C | 60W |

FOREIGN PATENT DOCUMENTS

| | | |
|---|---|---|
| JP | 7-319317 | 12/1995 |
| JP | 08-022206 | 1/1996 |
| JP | 11-194653 | 7/1999 |
| JP | 2001-318560 | 11/2001 |

OTHER PUBLICATIONS

U.S. Appl. No. 10/757,988 to Monda et al.
U.S. Appl. No. 10/765,974 to Nonaka et al.
U.S. Appl. No. 10/765,918 to Nonaka et al.
U.S. Appl. No. 10/779,615 to Asakura et al.
English Language Abstract of JP 5-274047.
English Language Abstract of JP 2001-318560.
English Language Abstract of JP 1-298385.
English Language abstract of JP 11-194653.
English Language abstract of JP 7-319317.

* cited by examiner

FIG. 7
100V SYSTEM
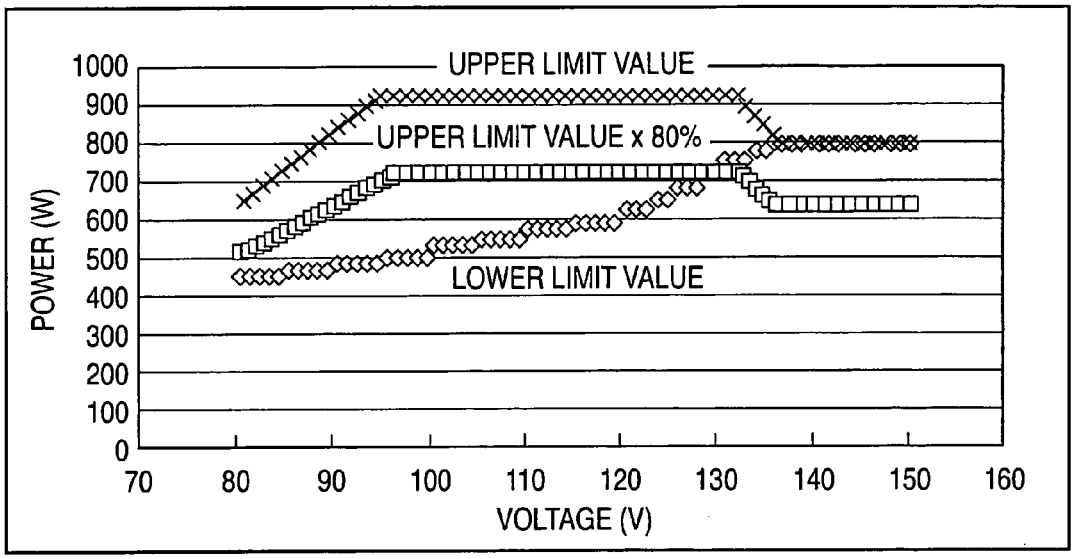
200V SYSTEM
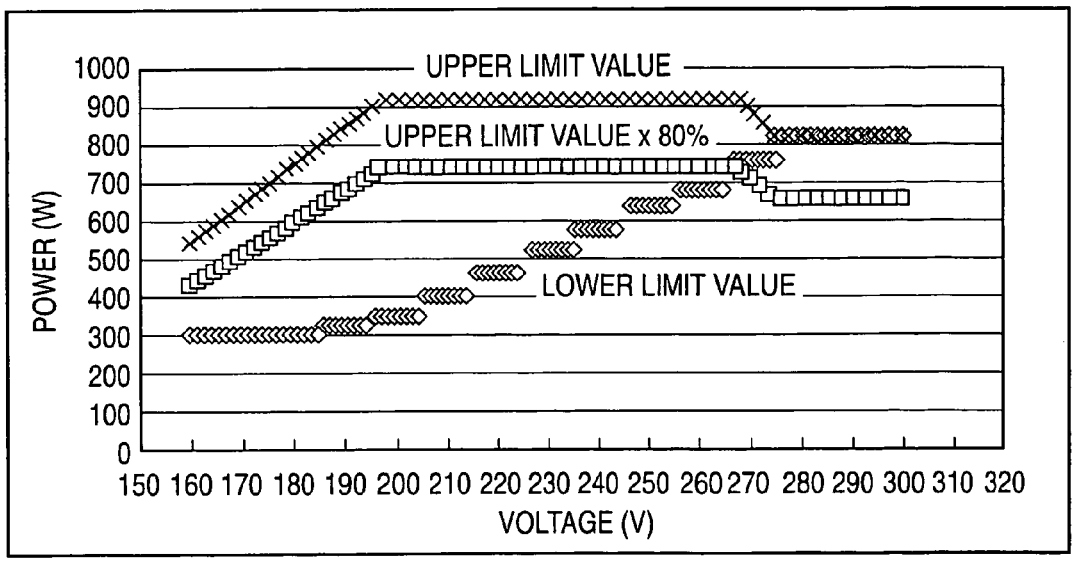

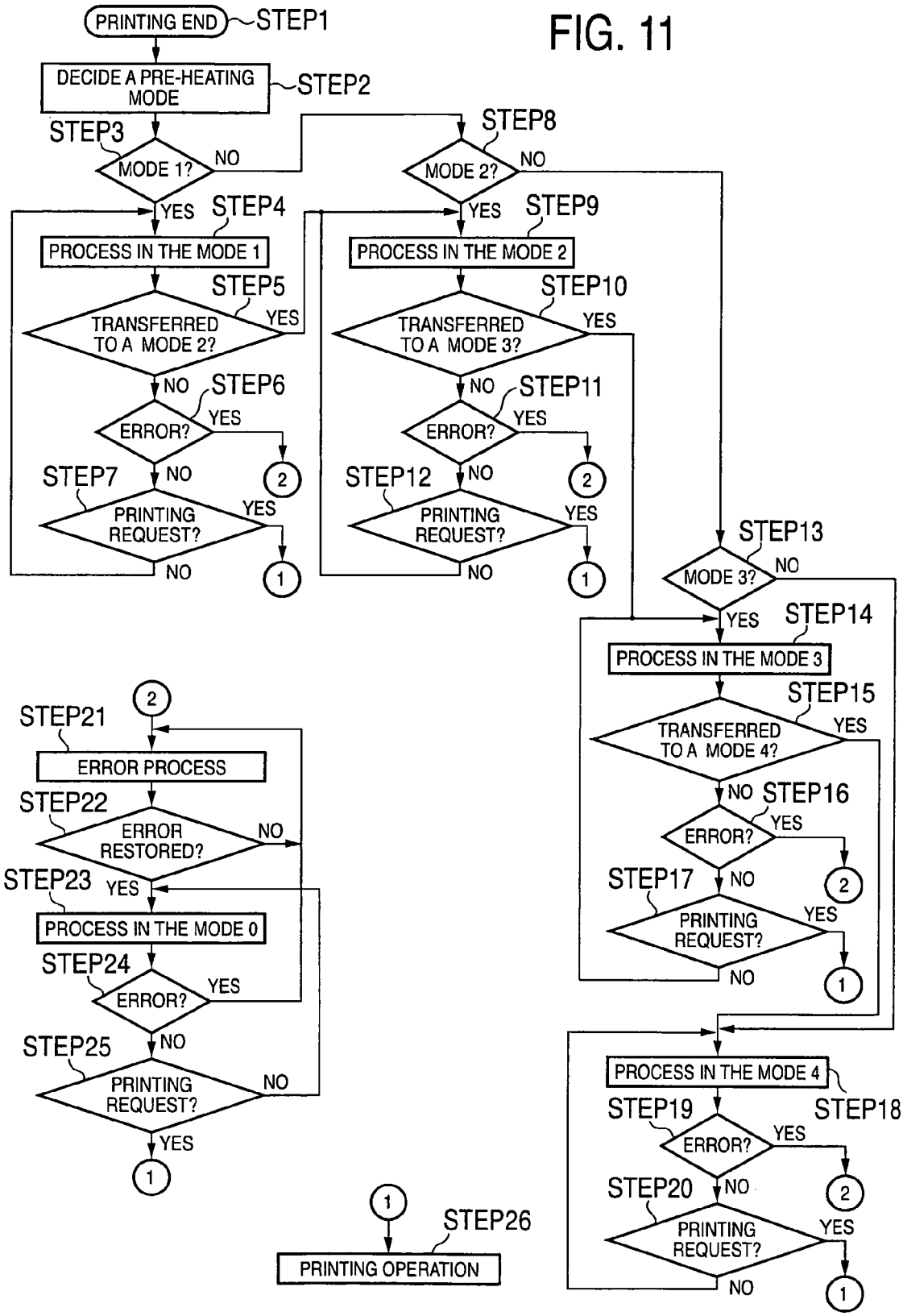
FIG. 11
PRINTING END
STEP1
DECIDE A PRE-HEATING MODE
STEP2
STEP3
MODE 1?
NO
YES
STEP4
PROCESS IN THE MODE 1
STEP5
TRANSFERRED TO A MODE 2?
YES
NO
STEP6
ERROR?
YES
NO
STEP7
PRINTING REQUEST?
YES
NO
STEP8
MODE 2?
NO
YES
STEP9
PROCESS IN THE MODE 2
STEP10
TRANSFERRED TO A MODE 3?
YES
NO
STEP11
ERROR?
YES
NO
STEP12
PRINTING REQUEST?
YES
NO
STEP13
MODE 3?
NO
YES
STEP14
PROCESS IN THE MODE 3
STEP15
TRANSFERRED TO A MODE 4?
YES
NO
STEP16
ERROR?
YES
NO
STEP17
PRINTING REQUEST?
YES
NO
PROCESS IN THE MODE 4
STEP18
STEP19
ERROR?
YES
NO
STEP20
PRINTING REQUEST?
YES
NO
STEP21
ERROR PROCESS
STEP22
ERROR RESTORED?
NO
YES
STEP23
PROCESS IN THE MODE 0
STEP24
ERROR?
YES
NO
STEP25
PRINTING REQUEST?
NO
YES
STEP26
PRINTING OPERATION

FIG. 12

| | ENVIRONMENTAL TEMPERATURE 15°C OR MORE | | | ENVIRONMENTAL TEMPERATURE 15°C OR LESS | | |
|---|---|---|---|---|---|---|
| | CONTROL UPPER LIMIT TEMPERATURE | CONTROL LOWER LIMIT TEMPERATURE | INITIAL CONTROL POWER | CONTROL UPPER LIMIT TEMPERATURE | CONTROL LOWER LIMIT TEMPERATURE | INITIAL CONTROL POWER |
| MODE 0 | 100°C | 97°C | 50W | 92°C | 87°C | 62.5W |
| MODE 1 | 130°C | 110°C | POWER DURING THE PRINTING | 130°C | 110°C | POWER DURING THE PRINTING |
| MODE 2 | 100°C | 97°C | 130W | 92°C | 87°C | 130W |
| MODE 3 | 100°C | 97°C | 100W | 92°C | 87°C | 100W |
| MODE 4 | 100°C | 97°C | 60W | 92°C | 87°C | 60W |

IMAGE FIXING CONTROLLER WITH TIME/TEMPERATURE CONTROL

BACKGROUND OF THE INVENTION

The present invention relates to an image forming apparatus such as a copying machine, a facsimile, a printer, and so on and, more particularly, an image fixing device using the electromagnetic induction.

The market needs for energy saving and higher speed on the image forming apparatus such as the copying machine, the facsimile, the printer, and the like are growing nowadays. In order to achieve these demanded performances, it is important to improve a thermal efficiency of the fixing device used in the image forming apparatus.

In the image forming apparatus, according to the image forming process such as electrophotographic recording, electrostatic recording, magnetic recording, or the like, the unfixed toner image is formed on the recording medium such as sheet member, printing paper, photosensitive paper, electrostatic recording paper, or the like by the image transfer process or the direct process. As the fixing device for fixing the unfixed toner image, the fixing device using the convective heating process such as heat roller process, film heating process, electromagnetic induction heating process, or the like is widely used.

As the fixing device using the electromagnetic induction heating process, in JP-A-8-22206, the technology to generate the Joule's heat by the eddy current, which is generated in the heat generating member made of the magnetic metal member by the magnetic field generated by the induction heating means made of the exciting coil, to cause the heat generating member to generate a heat based on the electromagnetic induction is proposed.

A configuration of the fixing device using the electromagnetic induction heating process in the prior art will be explained hereunder. Here, FIG. 18 is a view showing a fixing device using the electromagnetic induction heating process in the prior art.

As shown in FIG. 18, the fixing device is constructed by an exciting coil unit 1001 consisting of a ferrite core 1001*a* and an exciting coil 1001*b*, a heating roller 1002 made of magnetic metal member, a fixing roller 1003 having an elastic layer as a surface layer, a fixing belt 1004 stretched by the heating roller 1002 and the fixing roller 1003 and having a release layer as a surface layer, and a pressing roller 1005 opposed to the fixing roller 1003 to press it. The nip portion is formed between the fixing roller 1003 and the pressing roller 1005. The heating roller 1002, the fixing roller 1003, and the fixing belt 1004 are rotated and moved in a clockwise direction, as indicated by an arrow D, by a driving means (not shown). The pressing roller 1005 is driven by the driving means (not shown) so that it is rotated and moved in a counterclockwise direction D2. i.e. in a direction opposite to the direction indicated by an arrow D.

According to the result calculated by a software to maintain the fixing belt 1004 at a predetermined temperature based on temperature information sensed by a temperature sensing means 1006, a current is supplied to the exciting coil 1001*b* from an inverter circuit (not shown) to generate an alternating magnetic field (not shown). The alternating magnetic field generated by the exciting coil 1001*b* generates the eddy current in the heating roller 1002. Then, this eddy current is converted into a heat (Joule's heat) due to the electric resistance of the heating roller 1002 to cause the heating roller 1002 to generate the heat, so that the fixing belt 1004 is heated.

In the situation that the temperature of the fixing belt 1004 rises to a predetermined temperature, when a recording member 1007 on which unfixed toner images 1008 are formed by an image forming portion (not shown) is introduced into the nip portion formed by between the fixing roller 1003 and the pressing roller 1005, such recording member 1007 is carried into the fixing nip portion while being put between the fixing belt 1004 and the pressing roller 1005 and as a result the unfixed toner images 1008 on the recording member 1007 are fused and fixed onto the recording member 1007.

Also, the heating roller 1002, the fixing roller 1003, the fixing belt 1004, the pressing roller 1005, and the temperature sensing means 1006 are constructed as one fixing unit 1009. Thus, the user can exchange the fixing unit when such unit comes to the end of lifetime.

In this case, the recording member 1007 is separated from a surface of the fixing belt 1004 when it passes through the exit of the fixing nip portion, and then carried into a paper discharge tray (not shown).

According to the fixing device constructed as above, a heat generating efficiency can be improved and a warm-up can be further shortened.

In such fixing device using the electromagnetic induction heating process, the heating portion has a good heat generating efficiency, nevertheless the conventional software applied to control the temperature of the fixing device lacks the responsibility and the reliability to follow the very quick temperature rise. Therefore, there exists the problems such that the fixing device can not satisfy required specifications for the image fixing, the fixing device lacks the safety due to the delay in the response to sense the abnormality, and so forth.

Further, the necessity to satisfy the market need for a higher operation speed arises quickly and for that purpose the fixing device must be heated in the standby state (this mode is referred to as a "pre-heating mode" hereinafter) other than the image forming operation. Therefore, there existed the problem that such request cannot be sufficiently satisfied by the conventional temperature control of the fixing device.

SUMMARY OF THE INVENTION

Therefore, it is an object of the present invention to provide a highly reliable image fixing device in which a power controlling means for controlling a power value that is output from an inverter circuit, a power-value calculating means for calculating the power value, a power-value sensing means for acquiring the power value output from the power controlling means, and a temperature sensing means for sensing a temperature value of a heat generating member are provided to decide the power value that is applied to the inverter circuit by using power value information from the power-value sensing means or temperature value information from the temperature sensing means.

Further, it is another object of the present invention to provide an image fixing device capable of implementing a higher operation speed by executing temperature control of the fixing means in response to a predetermined fixing set temperature independent of the image forming operation.

In order to overcome the above subject, an image fixing device of the present invention is constructed to comprise a heat generating member for fixing a toner image onto a recording medium; an induction heating means arranged to oppose to the heat generating member, for generating heat in the heat generating member by electromagnetic induction;

an inverter circuit for driving the induction heating means; a power controlling means for controlling a power value that is output from the inverter circuit; a power-value calculating means for calculating the power value; a power-value sensing means for acquiring the power value output from the power controlling means; and a temperature sensing means for sensing a temperature at least at one point of the heat generating member; wherein either the power value sensed by the power-value sensing means or a temperature value sensed by the temperature sensing means is set as a reference value used to calculate the power value by the power-value calculating means.

Accordingly, it is made possible to comprise a heat generating member for fixing a toner image onto a recording medium, an induction heating means arranged to oppose to the heat generating member, for generating heat in the heat generating member by electromagnetic induction, an inverter circuit for driving the induction heating means, a power controlling means for controlling a power value that is output from the inverter circuit, a power-value calculating means for calculating the power value, a power-value sensing means for acquiring the power value output from the power controlling means, and a temperature sensing means for sensing a temperature at least at one point of the heat generating member, and thus to use either the power value sensed by the power-value sensing means or a temperature value sensed by the temperature sensing means as a reference value used to calculate the power value by the power-value calculating means.

Further, in order to overcome the subject, an image fixing device of the present invention for use in an image forming apparatus, which includes a plurality of image stations in which charging/exposing/developing means are arranged, a transferring means for transferring/carrying toner images formed in the plurality of image stations onto transferring material, and a fixing means for fixing the toner images on the transferring material, is constructed to comprise an induction heating means arranged to oppose to the fixing means, for generating a heat in the fixing means by electromagnetic induction; an inverter circuit for driving the induction heating means; a power controlling means for controlling a power value output from the inverter circuit; a power-value calculating means for calculating the power value; and a temperature sensing means for sensing a temperature at least at one point of the fixing means; wherein temperature control of the fixing means is executed in response to a predetermined fixing set temperature independent of whether or not an image forming operation is present.

BRIEF DESCRIPTION OF THE DRAWINGS

FIG. 7 is a view showing relationships of respective specified values between an input voltage and a power set value of the image fixing device as the first embodiment of the present invention.

FIG. 11 is a view showing a pre-heating mode controlling flow of the image fixing device as the second embodiment of the present invention.

FIG. 12 is a view showing applied voltages in pre-heating modes and control temperatures of the image fixing device as the second embodiment of the present invention.

DETAILED DESCRIPTION OF THE PREFERRED EMOBIDMENTS

First Embodiment

A first embodiment of the present invention will be explained with reference to FIG. 1 to FIG. 9 hereinafter. In this case, the same reference symbols are affixed to the same members throughout these drawings and their duplicate explanation will be omitted herein.

First, an outline of the image forming apparatus according to the present invention will be explained hereunder. Here, the image forming apparatus explained in the present embodiment is particularly associated with the tandem type image forming apparatus using the electrophotographic system, in which a developing device is provided every four fundamental color toners, which contribute to the color development of the color image respectively, and four-color images are superposed on the transferring body and then transferred collectively onto the sheet material. However, it is needless to say that the present invention is not limited to the tandem type image forming apparatus only and also the present invention can be employed in the image forming apparatus of all types irrespective of the number of the developing unit, the provision of the intermediate transferring body, and the like.

Figure 1:
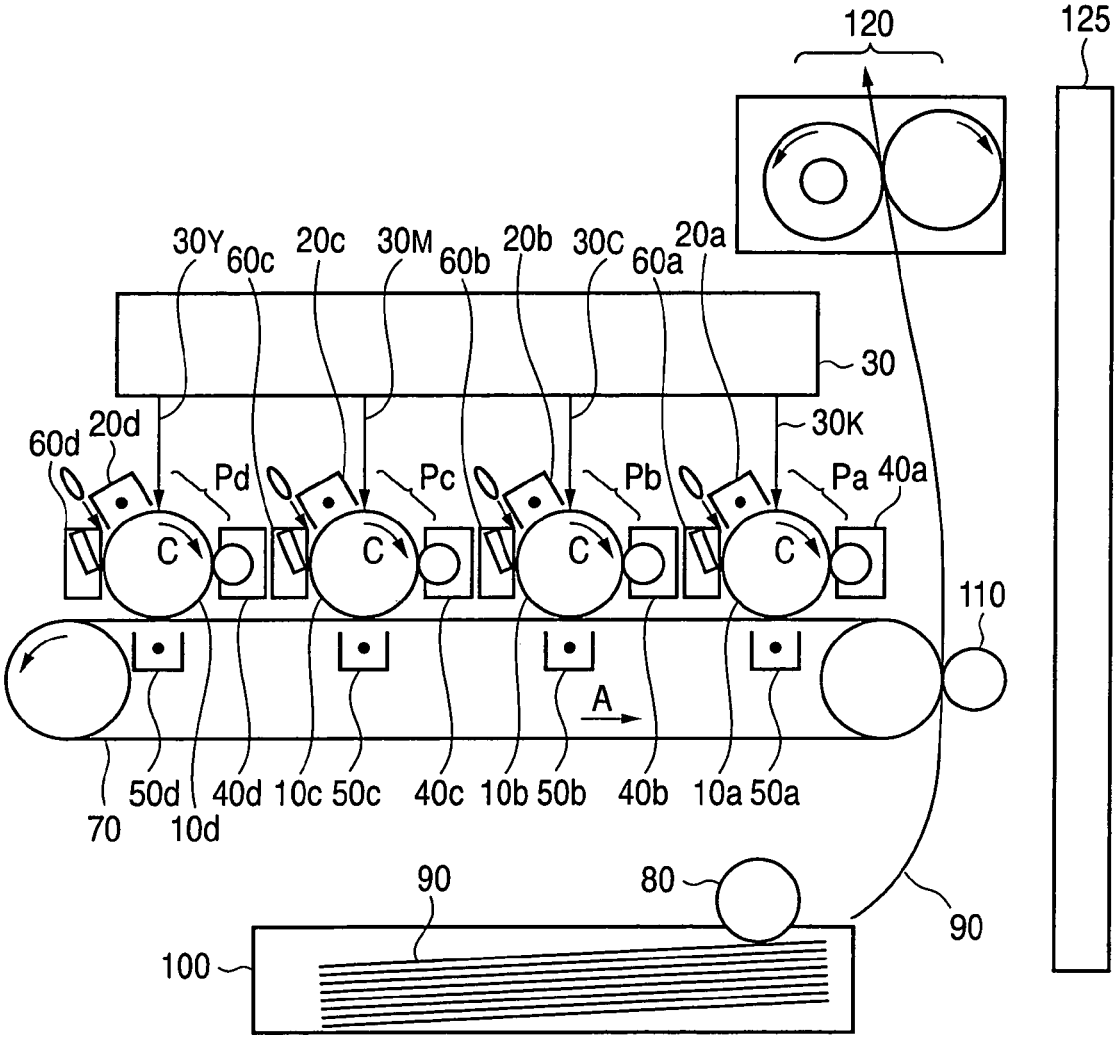
FIG. 1 is a configurative view of an image forming apparatus having a fixing device as an embodiment of the present invention.

In FIG. 1, charging means 20*a*, 20*b*, 20*c*, 20*d* for charging uniformly surfaces of photosensitive drums 10*a*, 10*b*, 10*c*, 10*d* at a predetermined potential, an exposing means 30 for forming electrostatic latent images by irradiating scanning lines 30K, 30C, 30M, 30Y of the laser beam corresponding to image data in particular colors onto the charged photosensitive drums 10*a*, 10*b*, 10*c*, 10*d*, developing means 40*a*, 40*b*, 40*c*, 40*d* for visualizing the electrostatic latent images formed on the photosensitive drums 10*a*, 10*b*, 10*c*, 10*d*, transferring means 50*a*, 50*b*, 50*c*, 50*d* for transferring the toner images rendered visible on the photosensitive drums 10*a*, 10*b*, 10*c*, 10*d* onto an endless intermediate transfer belt (intermediate transfer body) 70, and cleaning means 60*a*, 60*b*, 60*c*, 60*d* for removing residual toners remaining on the photosensitive drums 10*a*, 10*b*, 10*c*, 10*d* after the toner images are transferred onto the intermediate transfer belt 70 from the photosensitive drums 10*a*, 10*b*, 10*c*, 10*d* are arranged around the photosensitive drums 10*a*, 10*b*, 10*c*, 10*d* respectively.

Now the exposing means 30 is arranged at a predetermined slant to the photosensitive drums 10*a*, 10*b*, 10*c*, 10*d*, which turn, for example, in a clockwise direction indicated by a arrow C. Also, in the illustrated case, the intermediate transfer belt 70 is rotated in a direction indicated by an arrow A. In this case, a black image, a cyan image, a magenta image, and a yellow image are formed in image forming stations Pa, Pb, Pc, Pd respectively. Then, monochromatic images formed on the photosensitive drums 10*a*, 10*b*, 10*c*, 10*d* in respective colors are superposed in seriatim and transferred onto the intermediate transfer belt 70, and thus a full-color image is formed.

A paper feed cassette 100 in which sheet members (recording media) 90 such as printing papers, or the like are stored is provided under the apparatus. Then, the sheet members 90 are sent out one by one onto a paper carrying path from the paper feed cassette 100 by a paper feeding roller 80.

A sheet-member transferring roller 110 and a fixing unit 120 are arranged on the paper carrying path. The transferring roller 110 comes into contact with an outer peripheral surface of the intermediate transfer belt 70 over a predetermined length to transfer the color image formed on the intermediate transfer belt 70 onto the sheet member 90. The fixing unit 120 fixes the color image transferred onto the sheet member 90 on this sheet member 90 by the pressure and the heat caused when a pair of rollers are rotated while holding the sheet member between them.

Also, a door 125 constitutes a housing of the image forming apparatus and is opened/closed when the fixing unit 120 is to be exchanged, a jamming process is executed, and so forth.

In the image forming apparatus constructed in this manner, first the latent image of the image information in black component color is formed on the photosensitive drum 10*a*, by the charging means 20*a* and the exposing means 30 in the image forming station Pa. This latent image is rendered visible as the black toner image by the developing means 40*a* containing the black toner, and then transferred onto the intermediate transfer belt 70 by the transferring means 50*a* as the black toner image.

Meanwhile, the latent image in cyan component color is formed in the image forming station Pb while the black toner image is transferred onto the intermediate transfer belt 70, and then the cyan toner image formed by the cyan toner is rendered visible by the developing means 40*b*. Then, the cyan toner image is transferred onto the intermediate transfer belt 70, onto which the black toner image has already been transferred in the preceding image forming station Pa, by the transferring means 50*b* in the image forming station Pb and is superposed on the black toner image.

Subsequently, the magenta toner image and the yellow toner image are formed in the similar way. When the superposition of four-color toner images on the intermediate transfer belt 70 is ended, the four-color toner images are transferred collectively by the sheet-member transferring roller 110 on the sheet member 90 that is fed from the paper feed cassette 100 by the paper feeding roller 80. Then, the transferred toner images are thermally fixed onto the sheet member 90 by the fixing unit 120, whereby the full-color image is formed on the sheet member 90.

Next, the fixing device used in such image forming apparatus will be explained hereunder.

Figure 2:
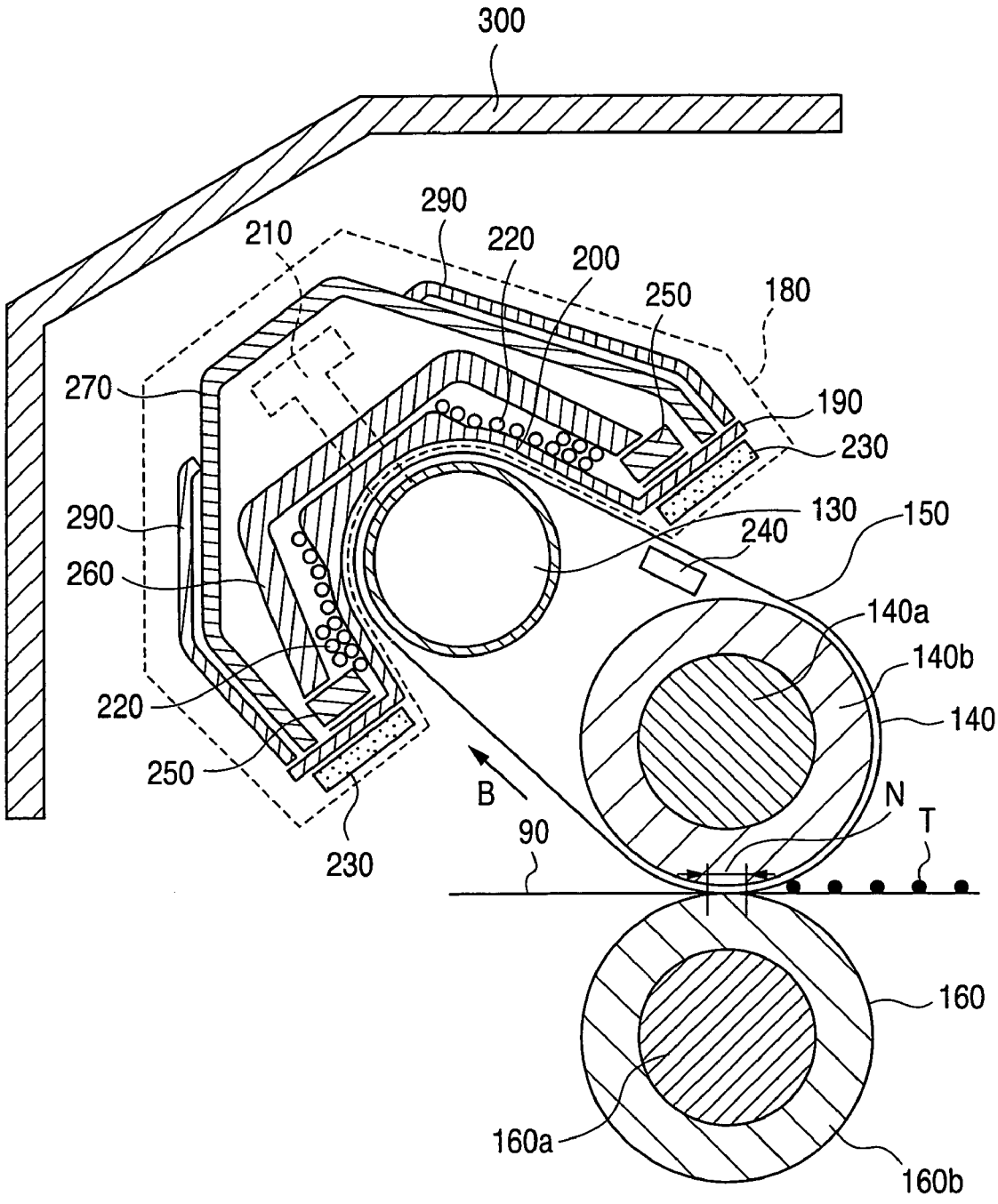
FIG. 2 is a configurative view of a fixing device using the electromagnetic induction heating process as an embodiment of the present invention used in the image forming apparatus in FIG. 1.

As shown in FIG. 2, the fixing device is constructed by a heating roller (heat generating member) 130 heated by the electromagnetic induction generated by an induction heating means 180, a fixing roller 140 arranged in parallel with the heating roller 130, an endless stripe-like heat resistant belt (toner heating medium) 150 stretched between the heating roller 130 and the fixing roller 140, heated by the heating roller 130, and rotated by rotating at least any one roller in the direction indicated by an arrow B, and a pressing roller 160 pushed against the fixing roller 140 via the heat resistant belt 150 and rotated in the forward direction with respect to the heat resistant belt 150.

The heat resistant belt 150 is formed of a hollow cylindrical rotating body made of the magnetic metal material such as iron, cobalt, nickel, alloy of these metals, or the like, for example. An outer diameter and a thickness of the belt are set to 20 mm and 0.3 mm respectively, for example, to get a small heat capacity and a quick temperature rise.

Figure 3:
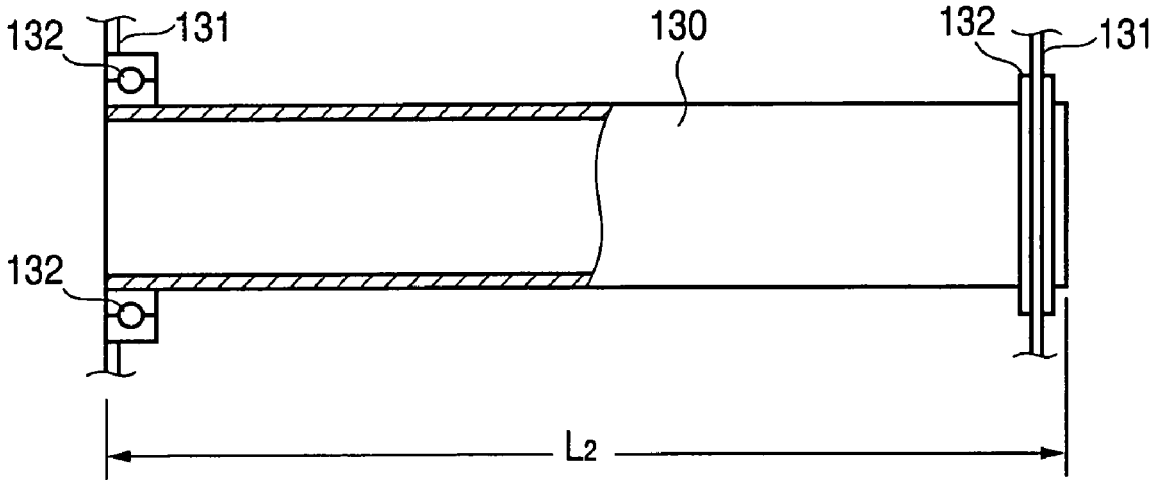
FIG. 3 is a sectional view of a heating roller as an embodiment of the present invention constituting the fixing device in FIG. 2.

As shown in FIG. 3, the heating roller 130 is rotatably supported at both ends by bearings 132 fixed to a supporting-side plate 131 made of a galvanized sheet iron, the roller 130, bearings 132 and side plate having a combined width of L2. The heating roller 130 is rotated/driven by the driving means. The heating roller 130 is formed of magnetic material as an alloy consisting of iron/nickel/chromium, and its Curie point is adjusted to exceed 300° C. Also, the heating roller 130 is formed like a pipe whose thickness is 0.3 mm.

A releasing layer (not shown) made of fluororesin having a thickness of 20 μm is coated on a surface of the heating roller 130 to provide the releasability. In this case, a resin or a rubber such as PTFE, PFA, FEP, silicon rubber, fluorine-containing rubber, or the like having the good releasability may be used solely or in combination as the releasing layer. Only the releasability should be assured in the case where the heating roller 130 is used to fix the monochromatic image. The elasticity should be further given in the case where the heating roller 130 is used to fix the color image. In such case, the thicker rubber layer must be formed.

The fixing roller 140 consists of a metallic core 140*a* made of stainless steel, for example, and an elastic member 140*b* made of solid or cellular silicon rubber with the heat resistance to coat the core 140*a*. Then, an outer diameter of the fixing roller 140 is set larger than the heating roller 130 and set to about 30 mm such that a fixing nip portion N is formed at a predetermined width between the pressing roller 160 and the fixing roller 140 by using a pressing force applied from the pressing roller 160. A thickness of the elastic member 140*b* is set to about 3 to 8 mm, and a hardness thereof is set to about 15 to 50° (Asker hardness:

hardness 6 to 25° in JIS A). According to this configuration, since a heat capacity of the heating roller 130 is reduced smaller than that of the fixing roller 140, the heating roller 130 can be heated quickly and a warm-up time can be shortened.

The heat resistant belt 150 stretched between the heating roller 130 and the fixing roller 140 is heated at a contact position with the heating roller 130 that is heated by the induction heating means 180. Then, the inner surface of the heat resistant belt 150 is heated continuously by the rotation of the heating roller 130 and the fixing roller 140, and as a result the overall heat resistant belt is heated.

The heat resistant belt 150 is a composite-layer belt that consists of a heat generating layer and a releasing layer. The heat generating layer uses a metal with magnetism such as iron, cobalt, nickel, or the like or their alloy as a base material. The releasing layer is made of elastic material such as silicon rubber, fluorine-containing rubber, or the like provided to cover the surface of the heat generating layer.

Because the composite-layer belt is employed, the belt can be heated directly, the heat generating efficiency can be improved, and a response can be accelerated.

Also, even if a foreign matter gets in between the heat resistant belt 150 and the heating roller 130 by any cause to generate a gap, for example, the temperature irregularity can be reduced and thus the reliability of fixing can be increased since the heat resistant belt 150 itself generates the heat by the electromagnetic induction in the heat generating layer of the heat resistant belt 150.

In FIG. 2, the pressing roller 160 consists of a core 160*a* formed of a cylindrical metal member such as copper, aluminum, or the like having high thermal conduction, for example, and an elastic member 160*b* provided onto the surface of the core 160*a* and having the high heat resistance and the high toner releasability. Also, in addition to the above metal, SUS may be employed as the core 160*a*.

The pressing roller 160 presses the fixing roller 140 via the heat resistant belt 150 to form the fixing nip portion N in which the sheet member 90, carrying a toner image T, is put between two rollers and carried. In the present embodiment, since a hardness of the pressing roller 160 is set higher than the fixing roller 140, the pressing roller 160 bites into the fixing roller 140 (and the heat resistant belt 150) and thus the sheet member 90 is caused to move along the circumferential shape of the surface of the pressing roller 160 owing to this biting. As a result, the present embodiment brings about the effect that the sheet member 90 can be easily released from the surface of the heat resistant belt 150. An outer diameter of the pressing roller 160 is set to about 30 mm like the fixing roller 140 but a thickness thereof is set thinner than the fixing roller 140 such as about 2 to 5 mm, and a hardness thereof is set harder than the fixing roller 140 such as 20 to 60° (Asker hardness: hardness 6 to 25° in JIS A), as described above. A temperature of the inner surface of the heat resistant belt 150 is sensed by a temperature sensing means 240 that is arranged in vicinity of the inlet side of the fixing nip portion N to come into contact with the inner surface side of the heat resistant belt 150. This temperature sensing means 240 is formed of a temperature transducer such as a thermistor, or the like having a high thermal response.

Next, a configuration of the induction heating means 180 will be explained hereunder.

As shown in FIG. 2, the induction heating means 180 for heating the heating roller 130 by the electromagnetic induction is arranged to oppose to the outer peripheral surface of the heating roller 130. A frame structure 300 is arranged to oppose the induction heating means 180 and the heating roller 130. A supporting frame (coil guiding member) 190 having a housing room 200 that is curved to cover the heating roller 130 and house the heating roller 130 therein is provided to the induction heating means 180. In this case, the supporting frame 190 is made of a flame-retardant resin.

A temperature sensing portion of a thermostat 210 is provided to be exposed partially to the heating roller 130 and heat resistant belt 150 from the supporting frame 190. Thus, the thermostat 210 senses the temperature of the heating roller 130 and heat resistant belt 150, and then interrupts forcedly the connection between an exciting coil 220 and the inverter circuit shown in FIG. 5 when it senses the abnormal temperature.

The exciting coil 220 formed by tying up a wire material having an insulated surface as a magnetic field generating means is wound around the outer peripheral surface of the supporting frame 190. The exciting coil 220 is formed by winding a long exciting coil wire alternately along the supporting frame 190 in the axial direction of the heating roller 130 (not shown). A winding length of the coil is set almost identical to an area in which the heat resistant belt 150 comes into contact with the heating roller 130.

The exciting coil 220 is connected to the inverter circuit. A high-frequency AC current of 10 kHz to 1 MHz, preferably a high-frequency AC current of 20 kHz to 800 kHz is supplied to the exciting coil to thereby generate an alternating magnetic field. Then, this alternating magnetic field acts on the heating roller 130 and the heat generating layer of the heat resistant belt 150 in the contact area between the heating roller 130 and the heat resistant belt 150 and its vicinity portion. Then, the eddy current flows through their insides in the direction to prevent the change of the alternating magnetic field.

This eddy current generates the Joule's heat in line with the resistance of the heating roller 130 and the heat generating layer of the heat resistant belt 150. Then, the heating roller 130 and the heat resistant belt 150 are heated by the electromagnetic induction mainly in the contact area between the heating roller 130 and the heat resistant belt 150 and its vicinity portion.

Figure 4:
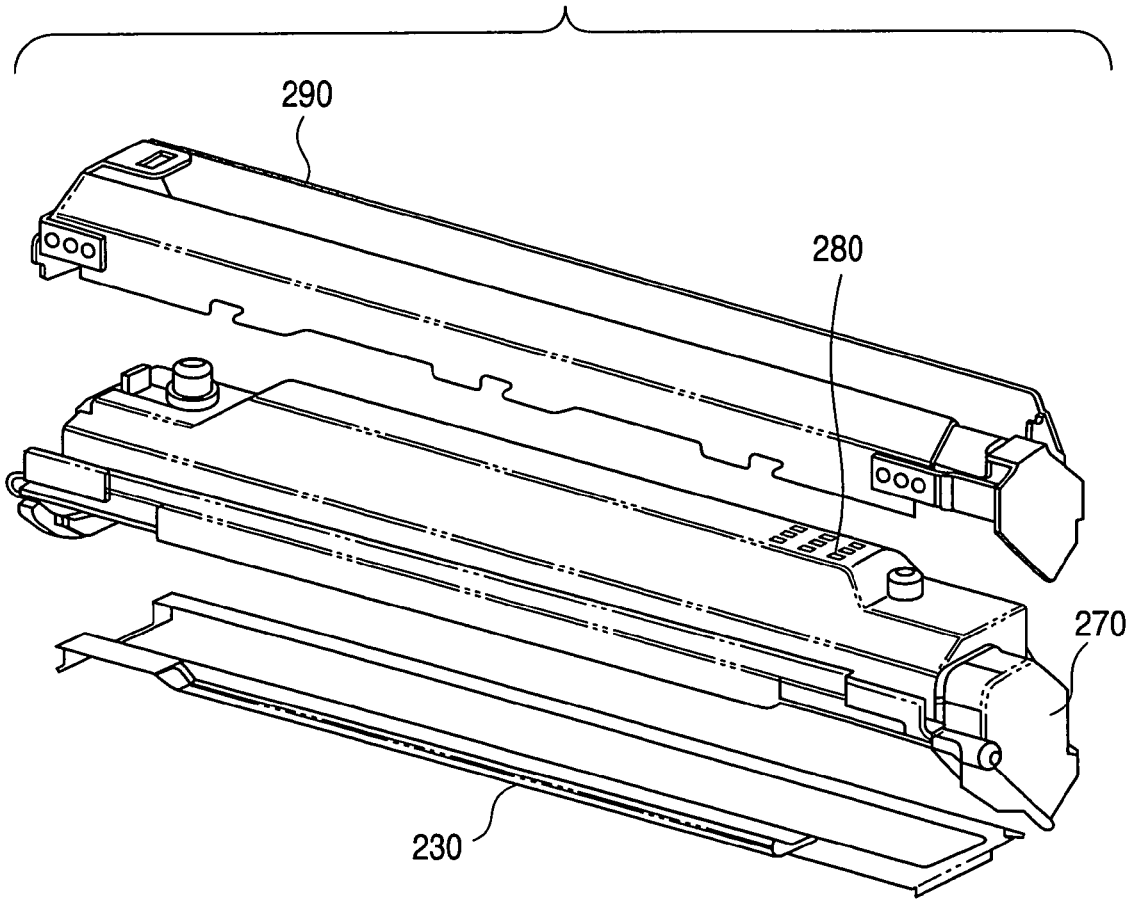
FIG. 4 is a configurative view of an exciting coil and a short ring as an embodiment of the present invention constituting the fixing device in FIG. 2.

As shown in FIG. 4, a short ring 230 is provided on the outside of the supporting frame 190 to surround the housing room 200. The eddy current is generated in the short ring 230 in the direction to cancel the leakage magnetic flux, which leaks out to the outside, out of the magnetic fluxes that are generated by passing the current through the exciting coil 220. When the eddy current is generated, the magnetic field is generated based on the Fleming's rule in the direction to cancel the magnetic field of the leakage magnetic flux. Thus, the unnecessary radiation caused by the leakage magnetic flux can be prevented.

The short ring 230 is made of copper or aluminum having a high conductivity, for example. Also, the short ring 230 may be set to the position where the magnetic flux for canceling the leakage magnetic flux can be generated.

An exciting coil core 250 is provided in the form to surround the housing room 200 of the supporting frame 190. A C-shaped coil core 260 is provided over the exciting coil core 250 to get astride the housing room 200 of the supporting frame 190.

Because the exciting coil core 250 and the C-shaped coil core 260 are provided, an inductance of the exciting coil 220 is increased and also the electromagnetic coupling between the exciting coil 220 and the heating roller 130 is improved. As a consequence, the greater electrical power can be put into the heating roller 130 even by the same coil current and thus the fixing device with a shorter warm-up time can be realized.

A housing 270 for covering an inner side of the induction heating means 180 is fitted on the opposite side of the heating roller 130 to put the exciting coil 220 between them. The housing 270 is made of a resin, for example, and is fitted to the supporting frame 190 like a roof to cover the C-shaped coil core 260 and the thermostat 210. In this case, the housing 270 may be made of other material except the resin. A plurality of radiation holes 280 are formed in the housing 270 shown in FIG. 4, and the heat that is emitted from the supporting frame 190, the exciting coil 220, the C-shaped coil core 260, and the like in the interior can be radiated to the outside through the holes.

A short ring 290 is fitted to the supporting frame 190 in the shape not to block up the radiation holes 280 formed in the housing 270.

The short ring 290 is similar to the above short ring 230 and is positioned at the back of the C-shaped coil core 260, etc., as shown in FIG. 4. Because the eddy current is generated in the direction to cancel the minute leakage magnetic flux that leaks out to the outside from the back of the C-shaped coil core 260, etc., the magnetic field is generated in the direction to cancel the magnetic field of the leakage magnetic flux and thus the unnecessary radiation caused by the leakage magnetic flux is prevented.

Figure 5:
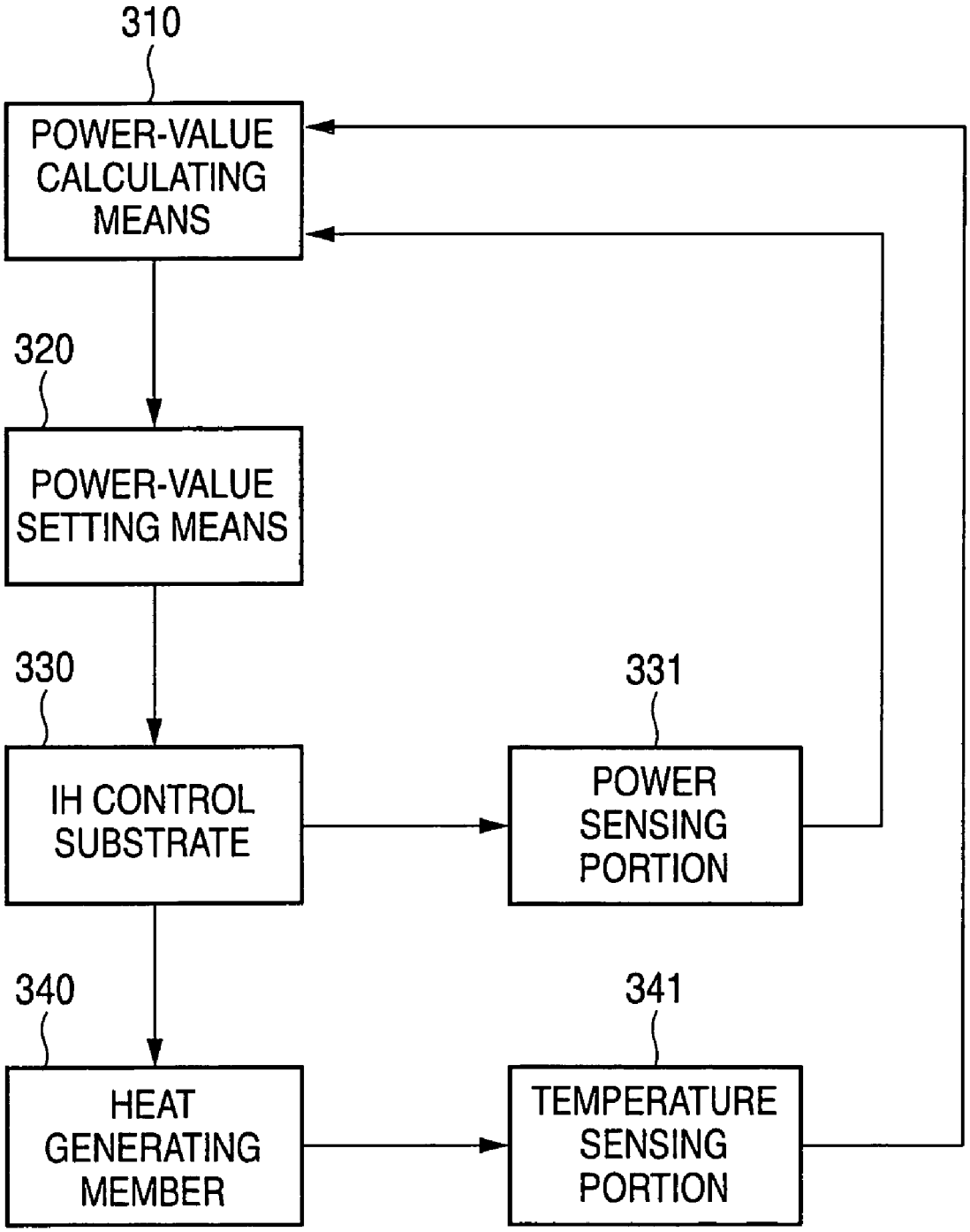
FIG. 5 is a block diagram of a power-value output controlling portion of the image fixing device as a first embodiment of the present invention.

Next, a control method of the image fixing device in the present invention will be explained with reference to FIG. 5 hereunder.

A power-value calculating means 310 calculates a power value to heat a heat generating member 340 and then outputs the value to a power-value setting means 320. A reference value used in the calculation depends on a temperature value of the heat generating member 340. The power value is chosen as the reference value when the temperature value is less than a specified value, while the temperature value is chosen as the reference value when the temperature value is more than the specified value. When the power value is set to the power-value setting means 320, the process of heating the heat generating member 340 by that power value is carried out in an IH control substrate 330. Then, the power value to be set in next time is calculated by the power-value calculating means 310 while using either the power value supplied from a power sensing portion 331 or the temperature value supplied from a temperature sensing portion 341 as the reference value. A series of these operations are executed in a specified period. Particular calculating approaches, calculating period, etc. will be described later.

Next, a control operation of the power setting portion of the image fixing device in the present invention will be explained with reference to FIG. 6, FIG. 7, FIG. 8 and FIG. 9 hereunder.

Figure 6:
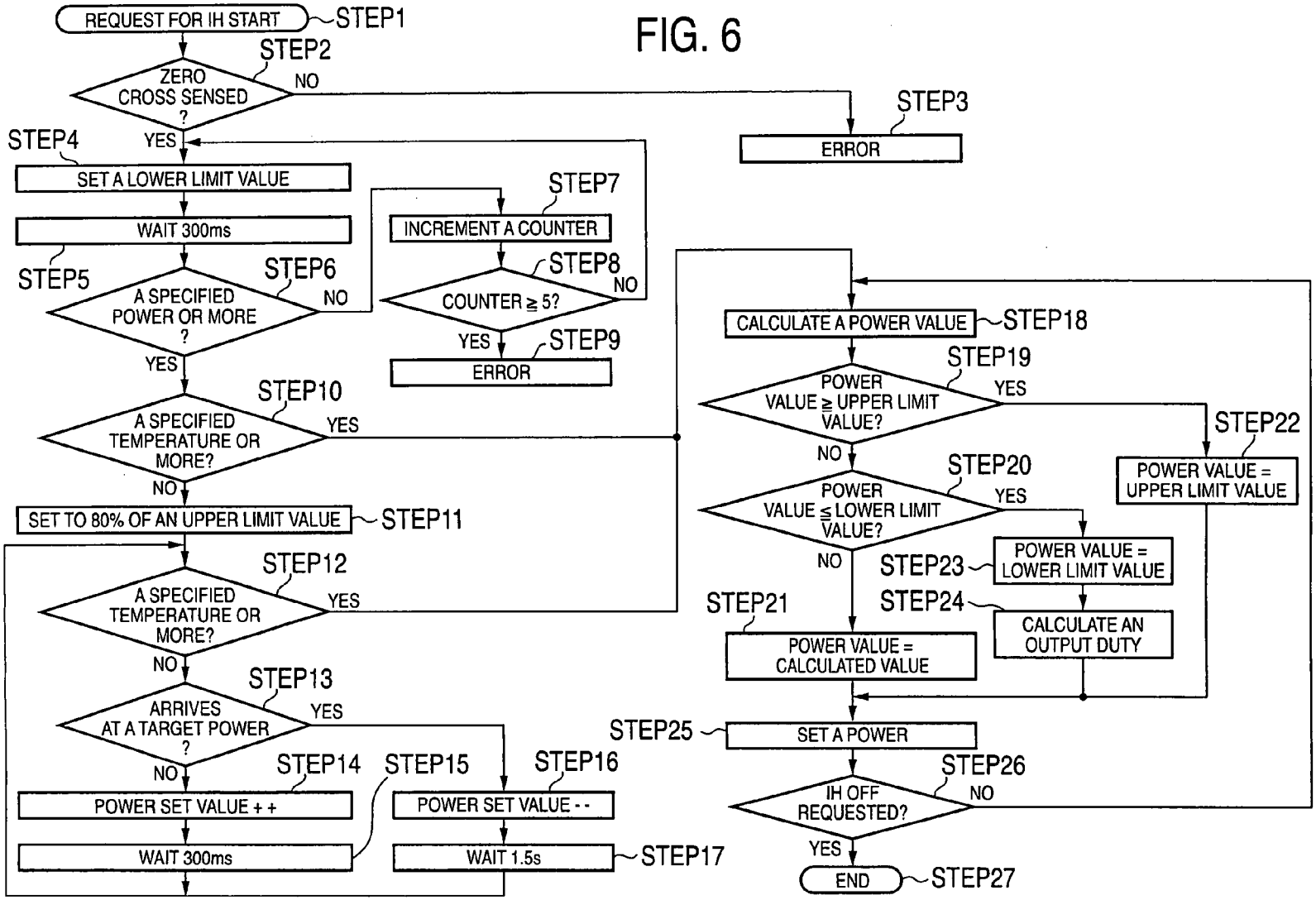
FIG. 6 is a flowchart of a power-value output controlling operation of the image fixing device as the first embodiment of the present invention.
Figure 8:
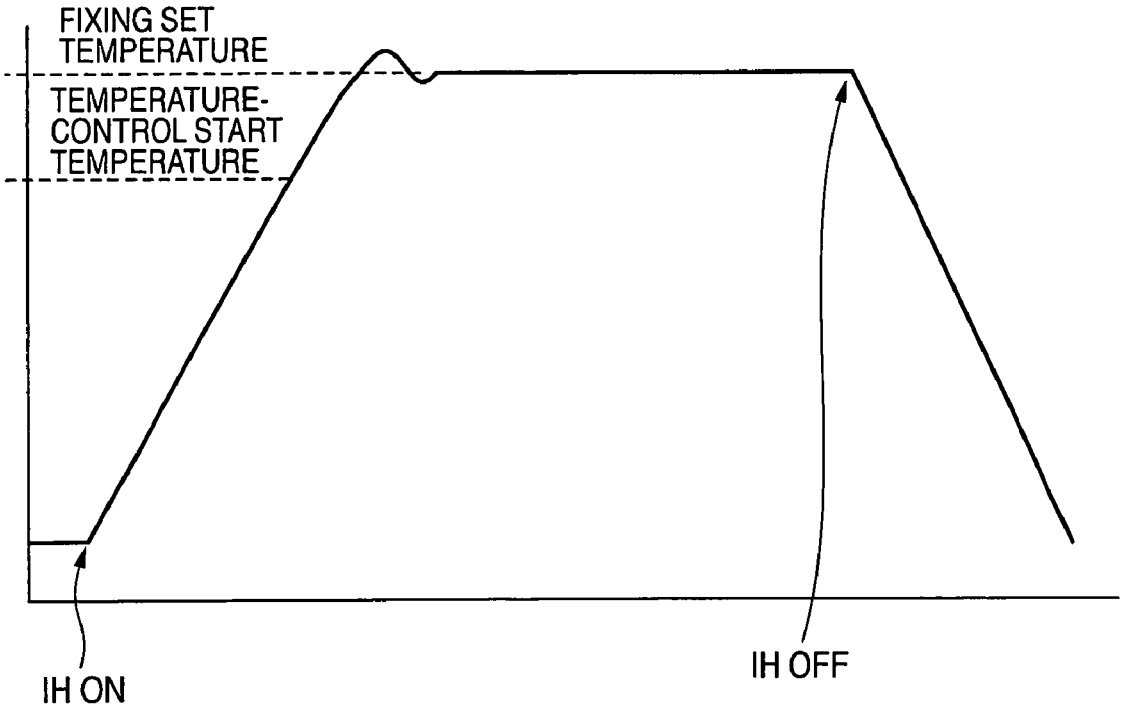
FIG. 8 is a view showing a fixing unit temperature state in a printing operation of the image fixing device as the first embodiment of the present invention.
Figure 9:
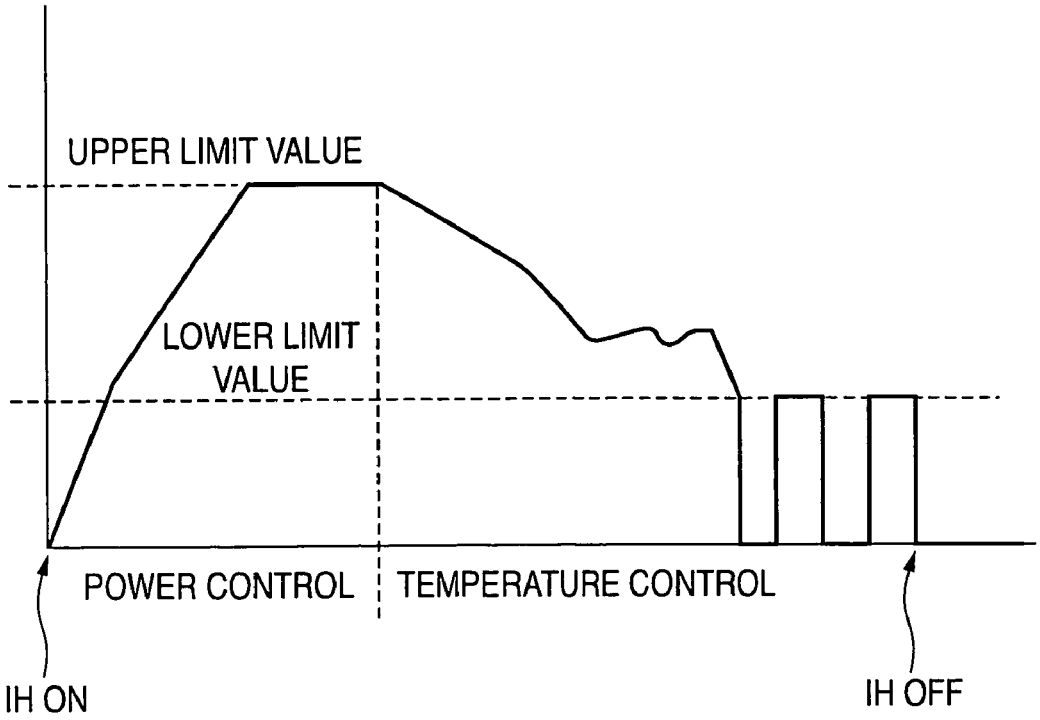
FIG. 9 is a view showing a power value state in the printing operation of the image fixing device as the first embodiment of the present invention.

FIG. 6 is a flowchart of a power-value output controlling operation of the image fixing device as the embodiment of the present invention. FIG. 7 is a view showing relationships of respective specified values between an input voltage and a power set value of the image fixing device as the embodiment of the present invention. FIG. 8 is a view showing a fixing unit temperature state in a printing operation of the image fixing device as the embodiment of the present invention. FIG. 9 is a view showing a power value state in the printing operation of the image fixing device as the embodiment of the present invention.

When a printing request, or the like is issued, the fixing device must be heated to fix the toner image. Therefore, a request for IH start is issued (Step 1). The IH control portion executes an IH ON process when the request for IH start is issued. This IH ON must be synchronized with a zero-crossing signal. If a zero-crossing is not sensed within a specified time (1 s in the embodiment of the present invention) (Step 2) after the IH ON start is requested, an operation of the apparatus is stopped as an error (Step 3). If the zero-crossing is sensed within the specified time, at first a minimum power value (lower limit value) that make it possible to execute the printing is set (Step 4). This minimum power value is varied by the power supply voltage, as shown in FIG. 7, and the value is updated every 10 ms in the embodiment of the present invention. The reason why the minimum power value is specified is to prevent the breakdown of the insulating element (IGBT) on the IH control circuit. Further, as shown in FIG. 7, an upper limit value and a lower limit value are set to the same value in the voltage range in excess of about 137 V in the 100 V system and in the voltage range in excess of about 275 V in the 200 V system. After the minimum power value is set, the device waits a specified time to sense the power value (Step 5). This specified time is 300 ms in the embodiment of the present invention. This time is required until the set power is reflected actually on the power sensing means, and is varied based on the characteristic of the IH control circuit. Then, it is determined whether or not the sensed power value exceeds the specified power (200 W in the embodiment of the present invention) (Step 6). If the sensed power value is lower than the specified value, a counter for counting the number of power check times is incremented (Step 7). Then, the process goes back to Step 4 to set the minimum power value. In contrast, if the number of power check times exceeds 5 times, i.e., the value of the counter for counting the number of power check times exceeds 5 (Step 8), the operation of the device is stopped as an error (Step 9).

Then, if the power in excess of the specified power is sensed by the power check, the temperature of the fixing unit is checked (Step 10). If the temperature of the fixing unit reaches the temperature or more at which the temperature control is started, the process goes to the temperature control (Step 18). In contrast, if the temperature of the fixing unit does not reach the temperature or more at which the temperature control is started, the power control is carried out until the temperature of the fixing unit reaches the temperature at which the temperature control is started. In the present embodiment, as shown in FIG. 8, the temperature at which the temperature control is started is set lower than the fixing setting temperature by several tens degree.

First, an operation executed when the temperature of the fixing unit does not reach the temperature or more at which the temperature control is started will be explained hereunder. Also, a power state in the printing operation is shown in FIG. 9. For the first time, the minimum value is set. Then, in the present embodiment, a power value corresponding to 80% of the maximum power value is set (Step 11). The reason why the power value smaller than the maximum power value is set is that overshoot of the power is caused depending upon the condition of the fixing unit if the maximum power value is set, and thus it is possible that the safety is damaged. Then, the temperature of the fixing unit is checked (Step 12). If the temperature of the fixing unit comes up to the temperature or more at which the temperature control is started, the process goes to the temperature control (Step 18). In contrast, if the temperature of the fixing unit does not come up to the temperature or more at which the temperature control is started, it is checked whether or not the power arrives at the maximum power (upper limit value) (Step 13). If the power does not arrive at the maximum power, the power set value is incremented (Step 14), and then the device waits 300 ms (Step 15). In contrast, if the power arrives at the maximum power, the power set value is decremented (Step 16), and then the device waits 1.5 s (Step 17). The reason why the wait time is set differently when the power value is incremented and when the power value is decremented is that a time required until the set power is stabilized is different respectively. Also, as shown in FIG. 7, the maximum power value is varied according to the power supply voltage, and the power value is updated every 10 ms in the embodiment of the present invention. If this power check is ended, the temperature check of the fixing unit in Step 12 is executed once again. The operation recited in Step 12 to Step 17 are repeated while the temperature of the fixing unit does not reach the temperature or more at which the temperature control is started.

Next, an operation executed when the temperature of the fixing unit reaches the temperature or more at which the temperature control is started will be explained hereunder. In this case, the reference value in the power value calculation becomes the temperature of the fixing unit, and then the so-called temperature control is carried out. The temperature condition of the fixing unit in the printing operation is shown in FIG. 8. At this time, the calculation is executed by a feedback control in which a to-be-set power value is calculated based on a difference between the temperature of the fixing unit and the set temperature of the fixing unit and their histories (Step 18).

Then, if the calculated power value is larger than the upper limit value (Step 19), the value in excess of the upper limit value cannot be set because it is possible that the breakage of the IH control circuit is caused by the application of the excessive power. Therefore, the power value is gated by the upper limit value (Step 22). Also, if the calculated power value is between the lower limit value and the upper limit value (Step 21), the power value is set as it is. Further, if the calculated power value is smaller than the lower limit value (Step 20), the power value that is less than the lower limit value cannot be set from a viewpoint of preventing the breakdown of the element on the IH control circuit, as described above. Therefore, the power value is gated by the lower limit value (Step 23). Then, an ON rate of the power value output is calculated (Step 24). More particularly, in the case where the power value calculated when the minimum power value is 400 W is 200 W, the power value is output at an ON Duty of 50% in a specified sampling period to realize 200 W artificially. The sampling period in the embodiment of the present invention is different according to the printing operation speed. The period is 200 ms in the case of low speed, while the period is 400 ms in the case of high speed.

The power value calculated as above is set (Step 25), and the temperature control of the fixing unit is carried out. The operations from Step 18 to Step 25 are continued until the printing end request is issued (Step 26). When the printing is ended, the power output control is also ended (Step 27).

As described above, according to the present invention, a heat generating member for fixing a toner image onto a recording medium, an induction heating means arranged to oppose to the heat generating member, for generating heat in the heat generating member by electromagnetic induction, an inverter circuit for driving the induction heating means, a power controlling means for controlling a power value that is output from the inverter circuit, a power-value calculating means for calculating the power value, a power-value sensing means for acquiring the power value output from the power controlling means, and a temperature sensing means for sensing a temperature at least at one point of the heat generating member are provided, and thus either the power value sensed by the power-value sensing means or a temperature value sensed by the temperature sensing means is used as a reference value used to calculate the power value by the power-value calculating means. Therefore, such a valuable effect can be achieved that the image fixing device can be controlled with the high reliability.

Also, the reference value used to calculate the power value by the power-value calculating means can be switched in dependence on the temperature value sensed by the temperature sensing means. Therefore, such a valuable effect can be achieved that the image fixing device can be controlled with the high reliability.

Also, the reference value used to calculate the power value by the power-value calculating means can be varied in response to an input voltage and updated in a predetermined period. Therefore, such a valuable effect can be achieved that the image fixing device can be controlled with the high reliability.

Also, the power value calculated by the power-value calculating means can be limited by using an upper limit value and a lower limit value and then output from the power controlling means. Therefore, such a valuable effect can be achieved that the image fixing device can be controlled with the high reliability.

Also, the upper limit value and the lower limit value can be varied in response to an input voltage and updated in a predetermined period. Therefore, such a valuable effect can be achieved that the image fixing device can be controlled with the high reliability.

Also, any one value of the upper limit value and the lower limit value can be set as the upper limit value or the lower limit value in a range where magnitudes of the upper limit value and the lower limit value are exchanged. Therefore, such a valuable effect can be achieved that the image fixing device can be controlled with the high reliability.

Also, in a case where the power value sensed by the power-value sensing means is set as the reference value used to calculate the power value by the power-value calculating means, the power controlling means first outputs the lower limit value and then outputs the power value that is calculated by the power-value calculating means based on the reference value and the power value sensed by the power-value sensing means. Therefore, such a valuable effect can be achieved that the image fixing device can be controlled with the high reliability.

Also, the power value that is first output from the power controlling means can be sensed by the power-value sensing means, then the power value can be sensed again by the power-value sensing means after a predetermined time lapsed when the sensed power value is different from a specified value, and then the device can be stopped as an error when the sensed power value is still different from the specified value even after such trial is executed plural times. Therefore, such a valuable effect can be achieved that the image fixing device can be controlled with the high reliability.

Also, an output period can be varied in either case where the power controlling means outputs the power value that is larger than a preceding value and the power controlling means outputs the power value that is smaller than the preceding value. Therefore, such a valuable effect can be achieved that the image fixing device can be controlled with the high reliability.

Also, the power controlling means can output the power value in synchronism with the zero-crossing signal. Therefore, such a valuable effect can be achieved that the image fixing device can be controlled with the high reliability.

Also, the device is stopped as an error when the zero-crossing signal is not sensed within a specified time. Therefore, such a valuable effect can be achieved that the image fixing device can be controlled with the high reliability.

Also, in a case where the temperature value sensed by the temperature sensing means is set as the reference value used to calculate the power value by the power-value calculating means, when the power value that is calculated by the power-value calculating means is smaller than the lower limit value, the power controlling means can output the power value that is calculated in response to a difference between the calculated power value and the lower limit value. Therefore, such a valuable effect can be achieved that the image fixing device can be controlled with the high reliability.

Also, the power value that is calculated in response to the difference between the calculated power value and the lower limit value can be varied in response to an operation state of the device. Therefore, such a valuable effect can be achieved that the image fixing device can be controlled with the high reliability.

Also, a series of operation sequences are stored in a nonvolatile memory. Therefore, such a valuable effect can be achieved that the image fixing device can be controlled with the high reliability.

Second Embodiment

A second embodiment of the present invention will be explained with reference to FIGS. 1 to 4, and FIGS. 10 to 17 hereinafter. In this case, the same reference symbols are affixed to the same members throughout these drawings and their duplicate explanation will be omitted herein.

An outline of the image forming apparatus according to the second embodiment is substantially same as that of the first embodiment.

Figure 10:
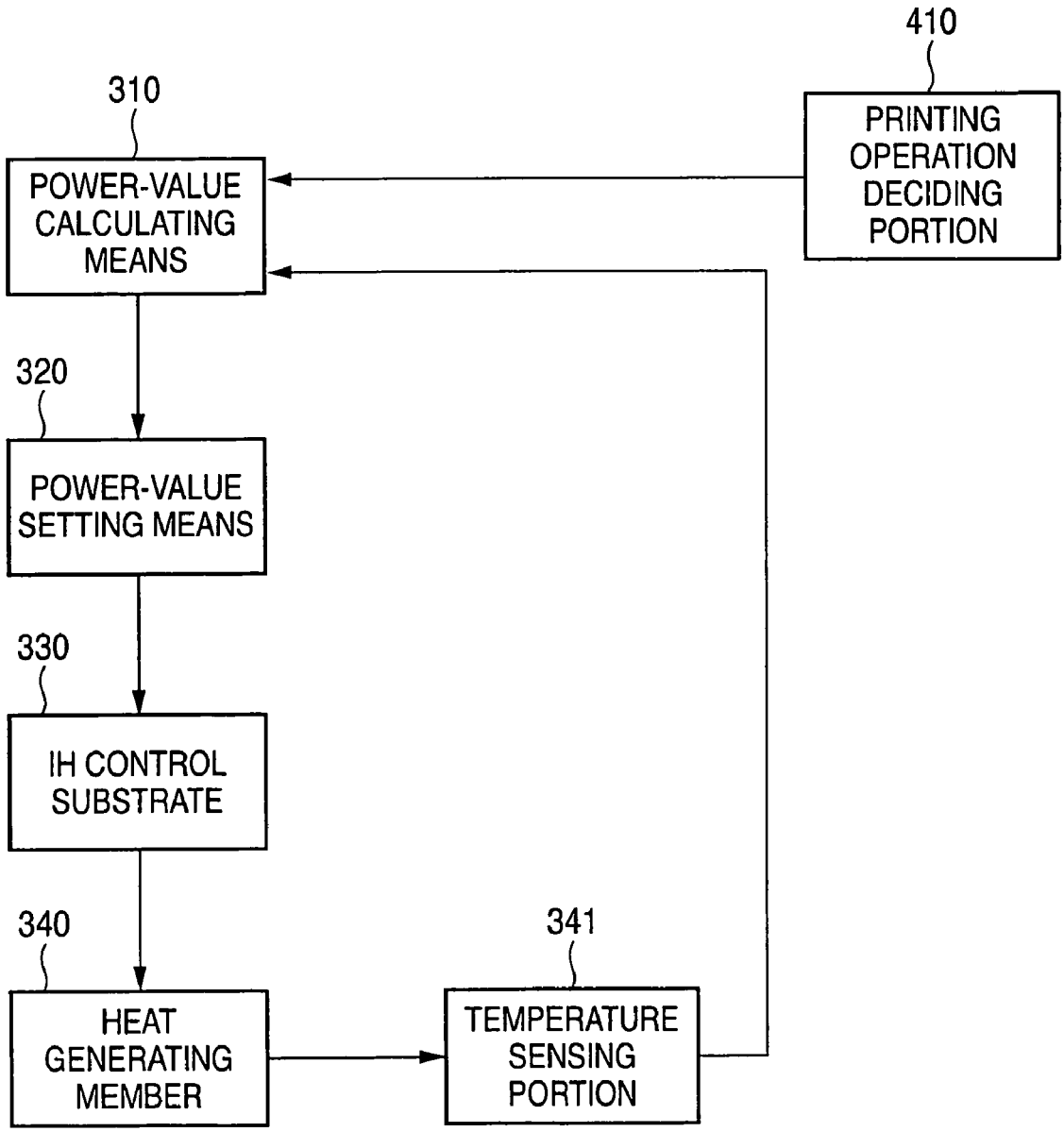
FIG. 10 is a block diagram of the power-value output controlling portion of the image fixing device as a second embodiment of the present invention.

Next, a control method of the image fixing device according to the second embodiment of the present invention will be explained with reference to FIG. 10 hereunder.

A power-value calculating means 310 calculates the power value to heat a heat generating member 340 and then outputs the value to a power-value setting means 320. At this time, the power-value calculating means 310 executes a power calculation corresponding to the printing operation when a signal indicating that the apparatus is in the printing operation is sent from a printing operation determining portion 410. Also, the power-value calculating means 310 executes a power calculation corresponding to a pre-heating operation in the standby operation when a signal indicating that the apparatus is not in the printing operation is sent from the printing operation determining portion 410. When the power value is set to the power-value setting means 320, the process of heating the heat generating member 340 by that power value is carried out in an IH control substrate 330. Then, the power value to be set in next time is calculated by the power-value calculating means 310 while using either the power value from a power sensing portion 331 or the temperature value from a temperature sensing portion 341 as the reference value. A series of these operations are executed in a specified period. Particular calculating approaches, calculating period, etc. will be described later.

Next, an operation of controlling the power setting portion of the image fixing device in the present invention will be explained with reference to FIG. 11, FIG. 12, FIG. 13, FIG. 14, FIG. 15, FIG. 16, and FIG. 17 hereunder.

The temperature control is carried out during the printing operation to fix the toner on the recording paper. When the printing operation is ended (step 1), the mode is shifted to the pre-heating mode to accelerate the printing speed in the next printing operation. A plurality of modes are present in the pre-heating mode. After the printing is ended, the process is classified into four modes, i.e., a pre-heating mode 1 to a pre-heating mode 4 in response to a time during which the temperature of the fixing unit goes down from the first state temperature (150° C. in the present embodiment) to the second state temperature (120° C. in the present embodiment) (step 2). The process is shifted to another mode as a pre-heating mode 0 when an error such as a door open, or the like, or a transition to an energy saving mode occurs during any one of the pre-heating modes 1 to 4 and the device is restored from the mode, or the like. Then, the pre-heating modes are classified as follows. In the present embodiment, the mode is decided as the pre-heating mode 1 (step 3) if a time during which the temperature of the fixing unit goes down from 150° C. to 120° C. is below 10 second, the mode is decided as the pre-heating mode 2 (step 8) if the time is more than 10 second but below 20 second, the mode is decided as the pre-heating mode 3 (step 13) if the time is more than 20 second but below 30 second, and the mode is decided as the pre-heating mode 4 if the time is more than 30 second.

Figure 13:
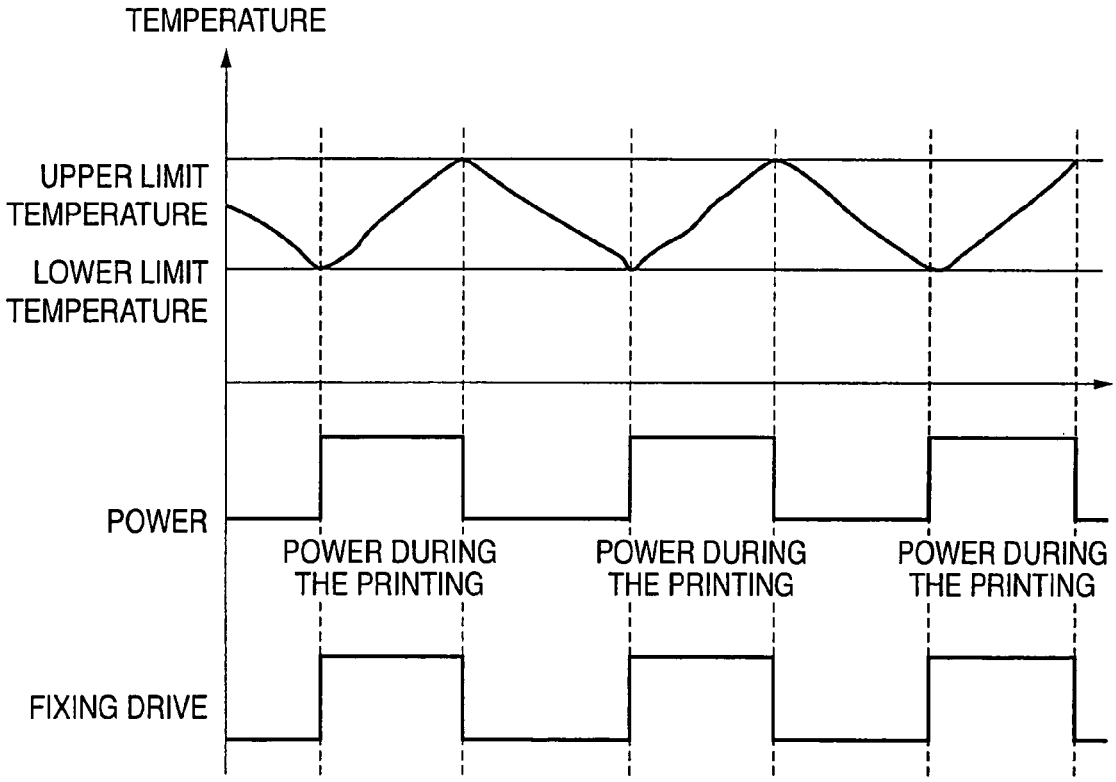
FIG. 13 is a view showing an IH control state in a pre-heating mode 1 of the image fixing device as the second embodiment of the present invention.

First, an operation in the pre-heating mode 1 will be explained (step 4). In the case of the pre-heating mode 1, as shown in FIG. 12, the temperature control is executed in a range from 110° C. to 130° C. when the environmental temperature is 15° C. or more, and the applied power at this time is identical to the power applied during the printing. Also, the temperature control is also executed in a range from 110° C. to 130° C. when the environmental temperature is below 15° C., and the applied power at this time is also identical to the power applied during the printing. This is because the fixing unit is rotated/driven only in the pre-heating mode 1. The process is brought into the pre-heating mode 1 when the fixing unit is not sufficiently warmed up. For this purpose, the overall fixing unit is warmed up by rotating/driving the fixing unit. A rotating/driving timing of the fixing unit is synchronized with the power applying timing. The fixing unit temperature state, the power applying state, and the fixing driving state in the pre-heating mode 1 are shown in FIG. 13.

During the execution of the pre-heating mode 1, it is decided whether or not the process is transferred to the pre-heating mode 2 (step 5).

The condition to shift the mode from the pre-heating mode 1 to the pre-heating mode 2 is satisfied when the number of power application times (=the number of fixing unit driven times) in the pre-heating mode 1 reaches the specified number. In the case of the present embodiment, the specified number is set to 10. Also, when an error such as a door open, or the like, or a transition to an energy saving mode occurs during the execution of the pre-heating modes 1, an error processing operation is executed (step 6). This error processing operation will be described later. Also, when the printing request is issued during the execution of the pre-heating modes 1 (step 7), the pre-heating modes 1 is ended and then the process is shifted to the printing operation (step 26). When the printing request is not issued, the process goes back to step 4 and the process in the pre-heating modes 1 is continued.

Then, an operation in the pre-heating mode 2 will be explained hereunder (step 9). The condition to start the pre-heating mode 2 is satisfied when the mode is shifted from the pre-heating modes 1 or when the time during which the temperature of the fixing unit goes down from 150° C. to 120° C. is more than 10 second but below 20 second, as described above.

In the case of the pre-heating mode 2, as shown in FIG. 12, the temperature control is executed in a range from 97° C. to 100° C. when environmental temperature is 15° C. or more, and the initial applied power at this time is a power that is equivalent to 130 W. Also, the temperature control is executed in a range from 87° C. to 92° C. when the environmental temperature is below 15° C., and the initial applied power at this time is a power that is equivalent to 130 W. The applied power that is equivalent to 130 W signifies that not the power of 130 W is directly applied but actually the power of about 500 W to 600 W (which is different based on the power supply voltage) is applied to PWM-output 300 W in a predetermined sampling period. The minimum output power is decided every power supply voltage to prevent the breakdown of the element (IGBT) on the IH substrate, and the value is about 500 W to 600 W in the practical voltage range. By way of a particular example, in order to get 130 W when the minimum output power is 520 W, a ¼ Duty may be applied to PWM-output. That is, when a sampling period is set to 500 ms, the power that is equivalent to 130 W can be applied by repeating such a cycle that the power is applied in a time 125 ms and the power is not applied in a remaining time 500−125=375 ms although the actually applied power is 520 W. In this manner, the power that is smaller than the minimum applicable power can be realized by executing the power application in the pre-heating mode. This process is common to the pre-heating mode 2 as well as the pre-heating mode 3, the pre-heating mode 4 and the pre-heating mode 0.

Figure 14:
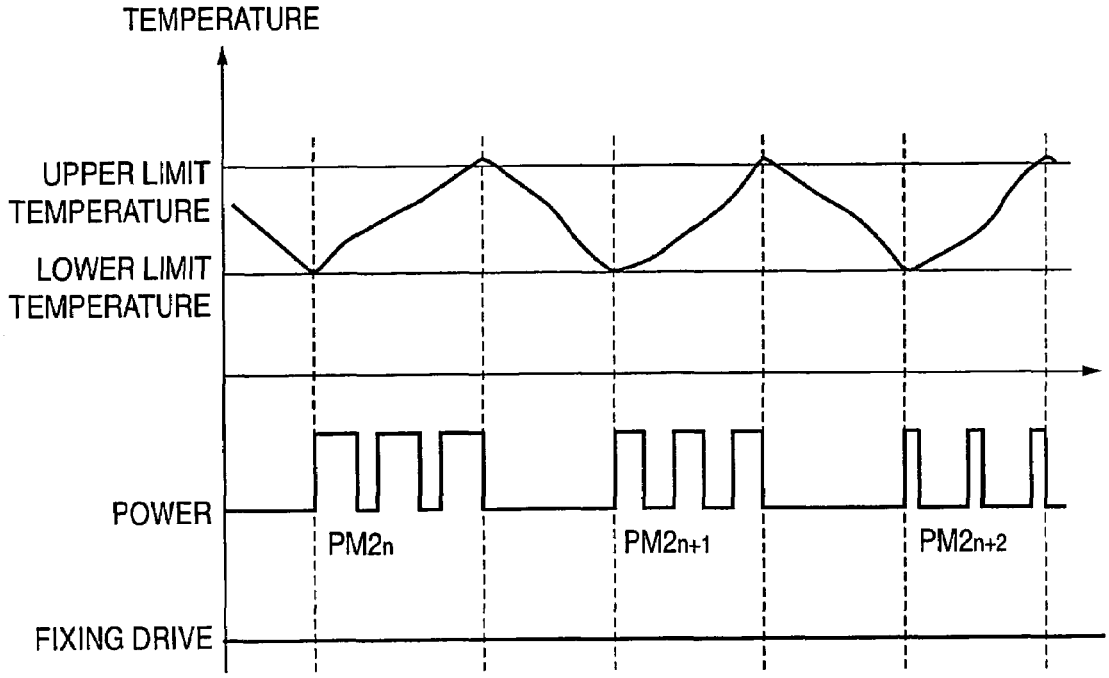
FIG. 14 is a view showing an IH control state in a pre-heating mode 2 of the image fixing device as the second embodiment of the present invention.

The initial applied power is 130 W in the pre-heating mode 2, but this value is attenuated at a predetermined attenuation rate. As shown in FIG. 14, the next applied power (e.g., PM2n+1) value is attenuated from the current applied power (e.g., PM2n) value at a predetermined attenuation rate and has a smaller value. In the present embodiment, this attenuation rate is 96%. This is true of not only the pre-heating mode 2 but also the pre-heating mode 3. The attenuation of power is proceeding and at the end the applied power is attenuated to the initial applied power of 100 W in the pre-heating mode 3, as shown in FIG. 12, and at that case the mode is shifted from the pre-heating mode 2 to the pre-heating mode 3. During the execution of the pre-heating mode 2, it is checked whether or not the process is transferred to the pre-heating mode 3 (step 10).

Also, when an error such as a door open, or the like, or a transition to an energy saving mode occurs during the execution of the pre-heating modes 2, the error processing operation is executed (step 11). If the printing request is issued during the execution of the pre-heating modes 2 (step 12), the pre-heating mode 2 is ended. Then, the process goes to the printing operation (step 26). If the printing request is not issued, the process goes back to step 9 and then the process in the pre-heating modes 2 is continued.

Then, an operation in the pre-heating mode 3 will be explained hereunder. The condition to start the pre-heating mode 3 is satisfied when the mode is shifted from the pre-heating modes 2 or when the time during which the temperature of the fixing unit goes down from 150° C. to 120° C. is more than 20 second but below 30 second, as described above.

Figure 15:
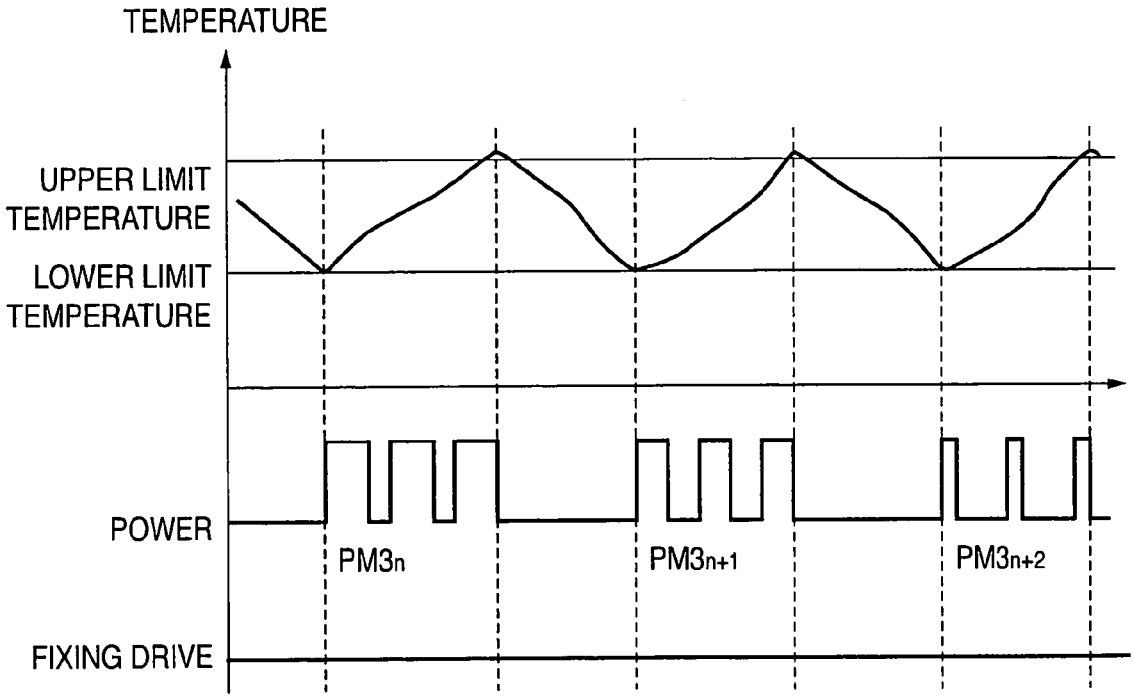
FIG. 15 is a view showing an IH control state in a pre-heating mode 3 of the image fixing device as the second embodiment of the present invention.

In the case of the pre-heating mode 3 (step 14), as shown in FIG. 12, the temperature control is executed in a range from 97° C. to 100° C. when environmental temperature is 15° C. or more, and the initial applied power at this time is a power that is equivalent to 100 W. Also, the temperature control is executed in a range from 87° C. to 92° C. when the environmental temperature is below 15° C., and the initial applied power at this time is a power that is equivalent to 100 W. Since the process of applying the power is similar to the pre-heating mode 2, its detailed explanation will be omitted herein. Then, the initial applied power is 100 W in the pre-heating mode 3, but this value is attenuated at a predetermined attenuation rate. As shown in FIG. 15, the next applied power (e.g., PM3n+1) value is attenuated from the current applied power (e.g., PM3n) value at a predetermined attenuation rate and has a smaller value. In the present embodiment, this attenuation rate is 96%. The attenuation of power is proceeding and at the end the applied power is attenuated to the initial applied power of 60 W in the pre-heating mode 4, as shown in FIG. 12, and at that case the mode is shifted from the pre-heating mode 3 to the pre-heating mode 4. During the execution of the pre-heating mode 3, it is checked whether or not the process is transferred to the pre-heating mode 4 (step 15).

Also, when an error such as a door open, or the like, or a transition to an energy saving mode occurs during the execution of the pre-heating modes 3, the error processing operation is executed (step 16). This error processing operation will be described later. If the printing request is issued during the execution of the pre-heating modes 3 (step 17), the pre-heating mode 3 is ended. Then, the process goes to the printing operation (step 26). If the printing request is not issued, the process goes back to step 14 and then the process in the pre-heating modes 3 is continued.

Then, an operation in the pre-heating mode 4 will be explained hereunder. The condition to start the pre-heating mode 4 is satisfied when the mode is shifted from the pre-heating modes 3 or when the time during which the temperature of the fixing unit goes down from 150° C. to 120° C. is more than 30 second, as described above.

Figure 16:
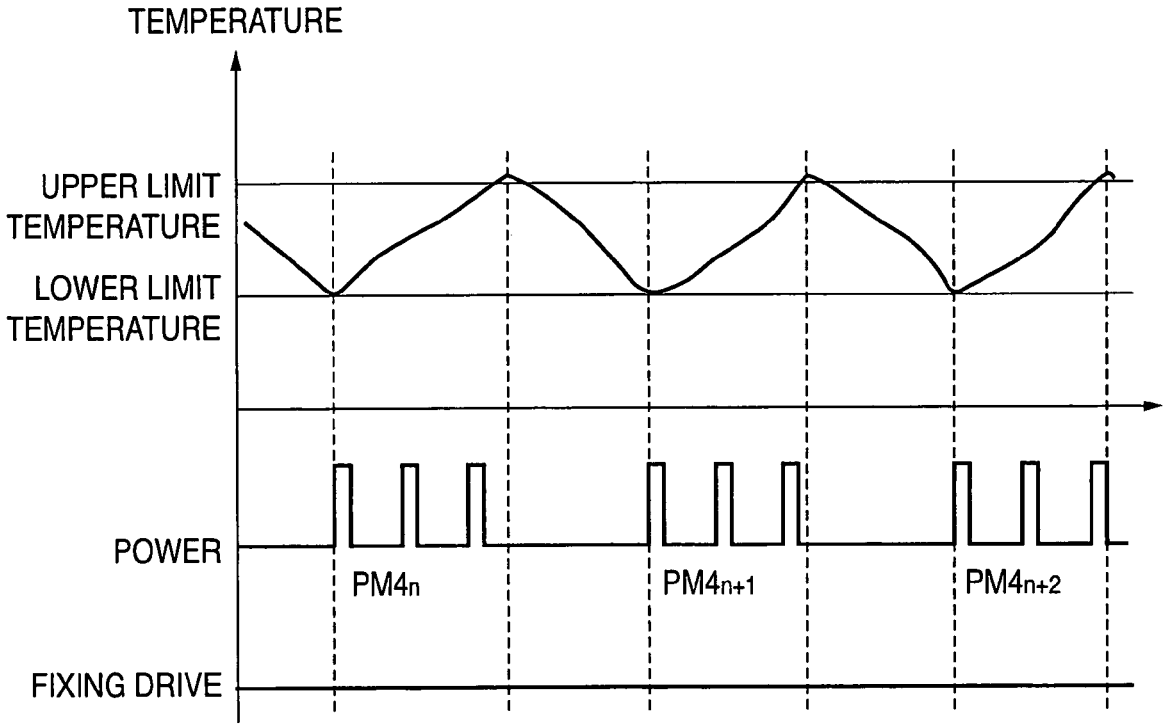
FIG. 16 is a view showing an IH control state in a pre-heating mode 4 of the image fixing device as the second embodiment of the present invention.

In the case of the pre-heating mode 4, as shown in FIG. 12, the temperature control is executed in the range from 97° C. to 100° C. when environmental temperature is 15° C. or more, and the initial applied power at this time is a power that is equivalent to 60 W. Also, the temperature control is executed in the range from 87° C. to 92° C. when the environmental temperature is below 15° C., and the initial applied power at this time is a power that is equivalent to 60 W. Since the process of applying the power is similar to the pre-heating mode 2 or the pre-heating mode 3, its detailed explanation will be omitted herein. Then, the initial applied power is 60 W in the pre-heating mode 4. Although this value is attenuated at a predetermined attenuation rate in the pre-heating mode 2 and the pre-heating mode 3, but this value is not attenuated in the pre-heating mode 4 and is still kept at the value that is equivalent to 60 W. As shown in FIG. 16, the next applied power (e.g., PM4n+1) value has an equal Duty to the current applied power (e.g., PM4n) value.

Also, when an error such as a door open, or the like, or a transition to an energy saving mode occurs during the execution of the pre-heating modes 3, the error processing operation is executed (step 19). This error processing operation will be described later. If the printing request is issued during the execution of the pre-heating modes 4 (step 20), the pre-heating mode 4 is ended. Then, the process goes to the printing operation (step 26). If the printing request is not issued, the process goes back to step 18 and then the process in the pre-heating modes 4 is continued.

Then, an error process in the pre-heating operation (step 21) will be explained hereunder. The condition to start this error process is satisfied when an error such as a door open, or the like occurs during any process in the pre-heating mode 0 to pre-heating mode 4 or when the process is transferred to the energy saving mode. The heating operation is not executed in the error such as a door open, or the like, and the energy saving mode. After the error is restored (step 22), the heating operation is started. The pre-heating mode when the error is restored is specified as the pre-heating mode 0 (step 23).

In the case of the pre-heating mode 0, as shown in FIG. 12, the temperature control is executed in the range from 97° C. to 100° C. when environmental temperature is 15° C. or more, and the initial applied power at this time is a power that is equivalent to 50 W. Also, the temperature control is executed in the range from 87° C. to 92° C. when the environmental temperature is below 15° C., and the initial applied power at this time is a power that is equivalent to 62.5 W. Since the process of applying the power is similar to the pre-heating mode 2, the pre-heating mode 3 or the pre-heating mode 4, its detailed explanation will be omitted herein.

Figure 17:
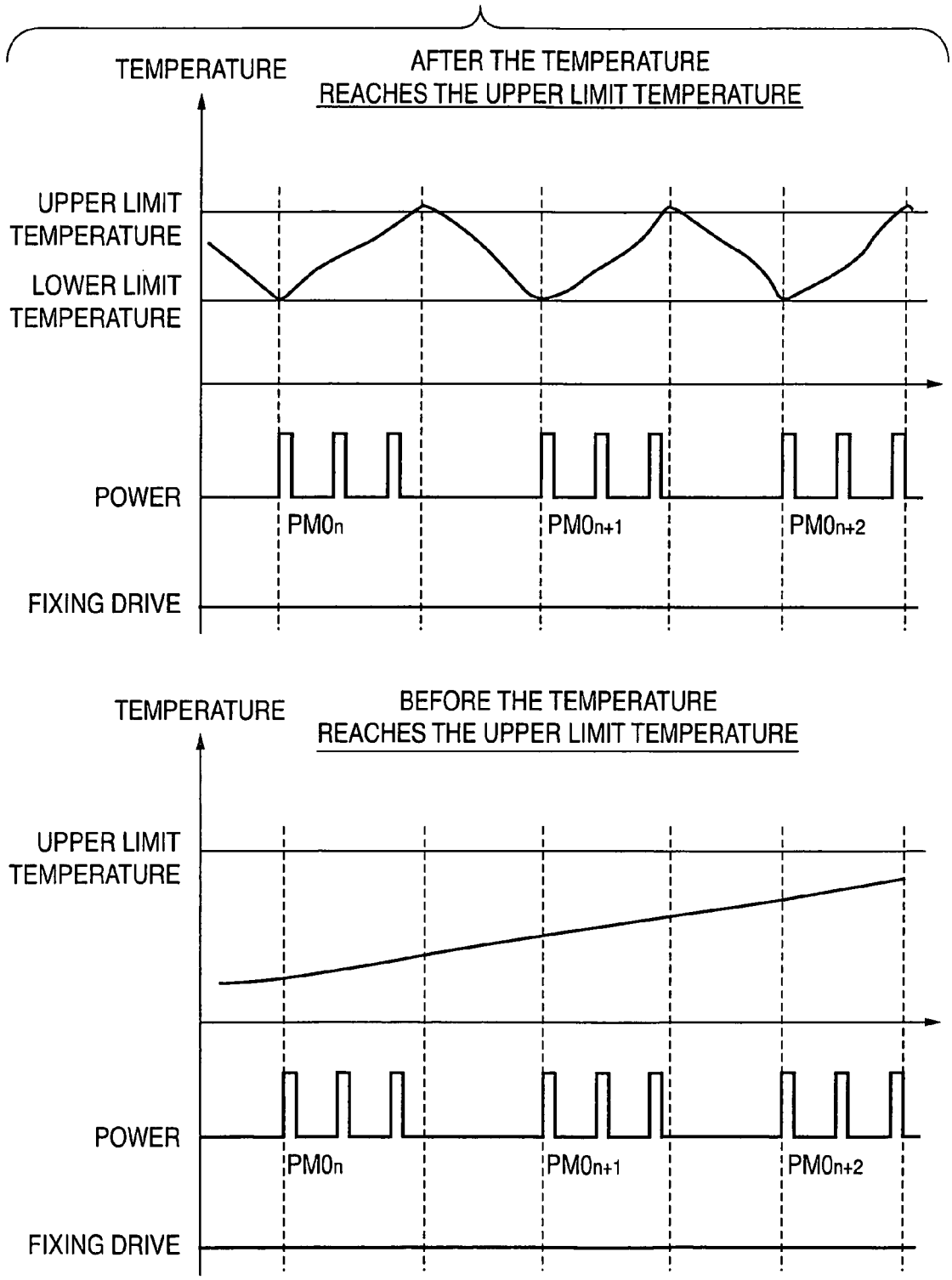
FIG. 17 is a view showing an IH control state in a pre-heating mode 0 of the image fixing device as the second embodiment of the present invention.
Figure 18:
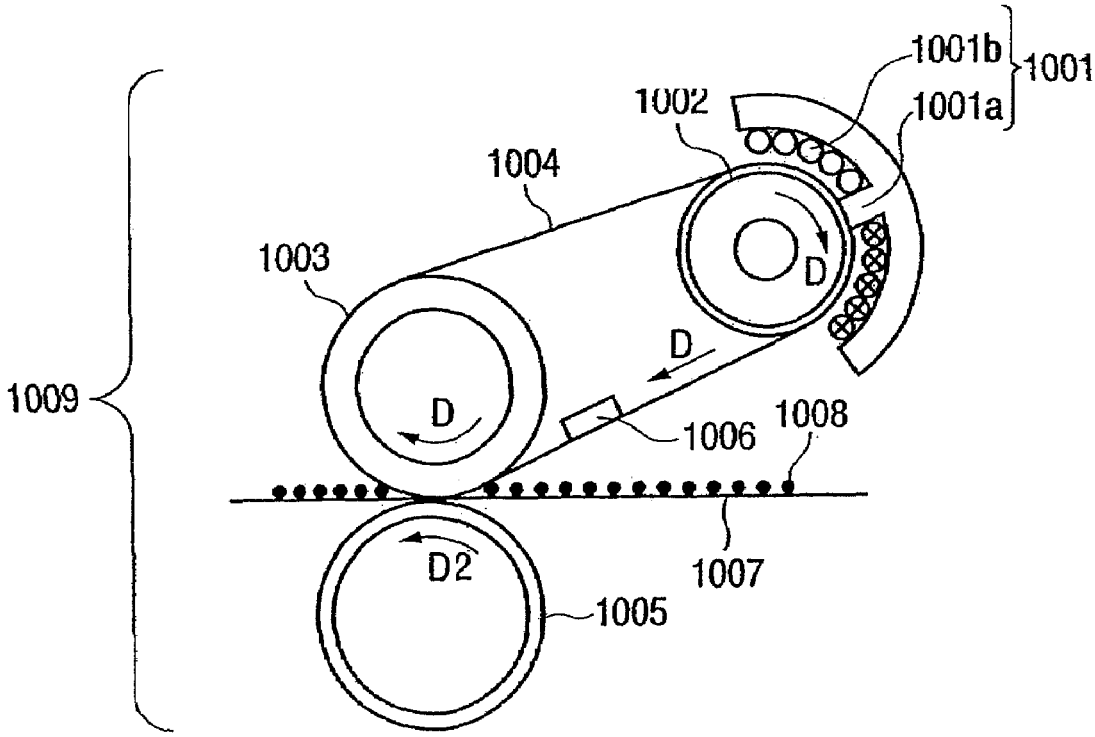
PRIOR ART FIG. 18
FIG. 18 shows a conventional fixing device using the electromagnetic induction heating process.

As shown in FIG. 17, the next applied power (e.g., PM0n+1) value has an equal Duty to the current applied power (e.g., PM0n) value. Also, since the pre-heating mode 0 is the process after the error is restored, the fixing unit is cooled when an error period is prolonged, and thus in some cases the temperature falls largely below the control temperature in the pre-heating mode 0 (for example, the temperature drops around the ordinary temperature of 20° C.). At this time, the power is applied in a predetermined period until the temperature reaches the upper limit temperature (see the lower portion in FIG. 17.

Also, when an error such as a door open, or the like, or a transition to an energy saving mode occurs during the execution of the pre-heating modes 0, the error processing operation is executed (step 24). If the printing request is issued during the execution of the pre-heating modes 0 (step 25), the pre-heating mode 0 is ended. Then, the process goes to the printing operation (step 26). If the printing request is not issued, the process goes back to step 23 and then the process in the pre-heating modes 0 is continued.

As described above, according to the present invention, there can be provided an image fixing device for use in an image forming apparatus having a plurality of image stations in which charging/exposing/developing means are arranged, a transferring means for transferring/carrying toner images formed in the plurality of image stations onto transferring material, and a fixing means for fixing the toner images on the transferring material, which comprises an induction heating means arranged to oppose to the fixing means, for generating a heat in the fixing means by electromagnetic induction; an inverter circuit for driving the induction heating means; a power controlling means for controlling a power value output from the inverter circuit; a power-value calculating means for calculating the power value; and a temperature sensing means for sensing a temperature at least at one point of the fixing means; wherein temperature control of the fixing means can be executed in response to a predetermined fixing set temperature independent of whether or not an image forming operation is present. Therefore, such a valuable effect can be achieved that the device that has a high printing speed and is convenient for use can be provided.

Also, a control temperature by which the fixing means is controlled can be made different in either case where the image forming operation is present and where the image forming operation is not present. Therefore, such a valuable effect can be achieved that the device that has a high printing speed and is convenient for use can be provided.

Also, either a quantity of electric power being output from the power controlling means in the temperature control of the fixing means when the image forming operation is not present or whether or not the fixing means is to be driven can be decided, in response to a time during when a temperature of the fixing means goes down to a predetermined specified time after the image forming operation is ended. Therefore, such a valuable effect can be achieved that the device that has a high printing speed and is convenient for use can be provided.

Also, either a quantity of electric power being output from the power controlling means in the temperature control of the fixing means when the image forming operation is not present or whether or not the fixing means is to be driven can be decided, in response to a lapse time after the temperature control of the fixing means is executed when the image forming operation is not present. Therefore, such a valuable effect can be achieved that the device that has a high printing speed and is convenient for use can be provided.

Also, a control temperature in the temperature control of the fixing means can be executed when the image forming operation is not present is varied by a peripheral temperature of the image forming apparatus. Therefore, such a valuable effect can be achieved that the device that has a high printing speed and is convenient for use can be provided.

Also, a quantity of electric power output from the power controlling means can be varied or an output from the power controlling means can be stopped when a failure occurs in the image forming apparatus in the temperature control of the fixing means when the image forming operation is not present. Therefore, such a valuable effect can be achieved that the device that has a high printing speed and is convenient for use can be provided.

Also, a series of operation sequences can be stored in a nonvolatile memory. Therefore, such a valuable effect can be achieved that the device that has a high printing speed and is convenient for use can be provided.

The image fixing device according to the present invention is capable of achieving such an effective advantage that control of the image fixing device with high reliability can be carried out, and relates to the image forming apparatus such as the copying machine, the facsimile, the printer, and so forth, and more particularly is useful to the field of the image fixing device using the electromagnetic induction.

Further, the image fixing device of the present invention can achieve such an effect that the temperature control of the fixing means can be executed in response to a predetermined fixing set temperature independent of the image forming operations, and is suitable for the image fixing device in the image forming apparatus of which a higher operation speed is required.

This application is based upon and claims the benefit of priority of Japanese Patent Application No. 2003-279825 and 2003-279827 both filed on Jul. 25, 2004, the contents of which are incorporated herein by reference in its entirety.

What is claimed is:

1. An induction heating controller for an image forming apparatus having a fixer that fixes a toner image on a sheet and an induction heater that heats the fixer, the fixer being controlled in a predetermined manner during a printing operation of the image forming apparatus and being controlled in a manner different than the predetermined manner after completion of the printing operation, the heating controller comprising:

a temperature sensor configured to sense a temperature of the fixer; and a controller configured to determine a change in the temperature of the fixer sensed by said temperature sensor after completion of a printing operation of the image forming apparatus, and to control said induction heater in accordance with a length of a time period during which the temperature of the fixer changes from a first value to a second value.

2. The heating controller in accordance with claim 1, wherein said controller is configured to control the induction heater in accordance with a first temperature characteristic when the time period is less than a predetermined time and to control the induction heater in accordance with a second temperature characteristic when the time period is greater than the predetermined time.

3. The heating controller according to claim 2, wherein the first temperature characteristic comprises a first maximum temperature value and a first minimum temperature value, and the second temperature characteristic comprises a second maximum temperature value and a second minimum temperature value, the second maximum temperature value being less than the first maximum temperature value.

4. The heating controller according to claim 2, said controller being further configured to control the induction heater in accordance with a different temperature characteristic when an error is detected while the induction heater is being controlled in accordance with one of the first or second temperature characteristics.

5. The heating controller according to claim 4, wherein the error comprises an open door.

6. The heating controller in accordance with claim 2, wherein the controller is further configured to control the power applied to the induction heater to be equal to the power applied during the printing operation when the induction heater is controlled according to the first temperature characteristic and to control the power applied to the induction heater to be different than the power applied during the printing operation when the induction heater is controlled according to the second temperature characteristic.

7. The heating controller according to claim 2, wherein the controller is configured to shift control of the induction heater from the first temperature characteristic to the second temperature characteristic when a number of times that power is applied to the fixing unit is greater than a predetermined number.

8. The heating controller in accordance with claim 2, wherein said controller is configured to shift control of the induction heater from one of the first temperature characteristic or the second temperature characteristic to a temperature characteristic of the printing operation when a printing request is detected while the induction heater is controlled according to the first or the second temperature characteristic.

9. The heating controller in accordance with claim 1, wherein said controller is configured to control the induction heater according to a first temperature characteristic when the time period is less than a predetermined time and to control the induction heater according to a second temperature characteristic when the time period is greater than the predetermined time, when the ambient temperature is less than a predetermined temperature, the controller being further configured to control the induction heater according to a third temperature characteristic when the time period is less than a predetermined time and to control the induction heater according to a fourth temperature characteristic when the time period is greater than the predetermined time, when the ambient temperature is greater than the predetermined temperature.

10. The heater controller in accordance with claim 1, wherein said controller is configured to control the induction heater in accordance with a first power value when the time period is less than a predetermined time and to control the induction heater in accordance with a second power value when the time period is greater than the predetermined time.

11. A method for controlling an induction heater for an image forming apparatus having a fixer that fixes a toner image on a sheet and an induction heater that heats the fixer, the fixer being controlled in a predetermined manner during a printing operation of the image forming apparatus and being controlled in a manner different than the predetermined manner after completion of the printing operation, the control method comprising:

sensing a temperature of the fixer;

determining a change in the sensed temperature of the fixer after completion of a printing operation; and controlling the induction heater in accordance with a length of a time period during which the temperature of the fixer changes from a first value to a second value.

12. The control method in accordance with claim 11, further comprising controlling the induction heater in accordance with a first temperature characteristic when the time period is less than a predetermined time and controlling the induction heater in accordance with a second temperature characteristic when the time period is greater than the predetermined time.

13. The control method according to claim 12, wherein the first temperature characteristic comprises a first maximum temperature value and a first minimum temperature value, and the second temperature characteristic comprises a second maximum temperature value and a second minimum temperature value, the second maximum temperature value being less than the first maximum temperature value.

14. The control method according to claim 12, further comprising controlling the induction heater in accordance with a different temperature characteristic when an error is detected while the induction heater is being controlled in accordance with one of the first or second temperature characteristics.

15. The control method in accordance with claim 12, further comprising:

controlling power applied to the induction heater to be equal to the power applied during a printing operation when the induction heater is controlled according to the first temperature characteristic; and controlling the power applied to the induction heater to be different than the power applied during the printing operation when the induction heater is controlled according to the second temperature characteristic.

16. The control method according to claim 12, further comprising shifting control of the induction heater from the first temperature characteristic to the second temperature characteristic when a number of times that power is applied to the fixing unit is greater than a predetermined number.

17. The control method according to claim 12, further comprising shifting control of the induction heater from one of the first temperature characteristic or the second temperature characteristic to a temperature characteristic of the printing operation when a printing request is detected while the induction heater is controlled according to the first or the second temperature characteristic.

18. The control method in accordance with claim 11, further comprising:

controlling the induction heater according to a first temperature characteristic when the time period is less than a predetermined time and controlling the induction heater according to a second temperature characteristic when the time period is greater than the predetermined time, when the ambient temperature is less than a predetermined temperature; and controlling the induction heater according to a third temperature characteristic when the time period is less than a predetermined time and controlling the induction heater according to a fourth temperature characteristic when the time period is greater than the predetermined time period when the ambient temperature is greater than the predetermined temperature.

19. The control method in accordance with claim 11, further comprising controlling the induction heater in accordance with a first power value when the time period is less than a predetermined time and controlling the induction heater in accordance with a second power value when the time period is greater than the predetermined time.

20. An image fixing device for use in an image forming apparatus having a plurality of image stations in which a charger, an exposer, and a developer are provided, the image forming apparatus further including a transfer mechanism that transfers toner images formed at the plurality of image stations onto a transfer material and a fixer that fixes the toner images on the transfer material, the image fixing device comprising:

an induction heater positioned in opposition to the fixer, the induction generating heat in the fixer by electromagnetic induction;

a temperature sensor that senses a temperature at least at one location of the fixer; and a controller configured to determine a change in the temperature of the fixer sensed by said temperature sensor after completion of a printing operation of the image forming apparatus, and to control said induction heater in accordance with a length of a time period during which the temperature of the fixer changes from a first value to a second value.

* * * * *